US009139398B2

(12) United States Patent
Hata et al.

(10) Patent No.: US 9,139,398 B2
(45) Date of Patent: Sep. 22, 2015

(54) SHEET PROCESSING APPARATUS AND IMAGE FORMING SYSTEM

(71) Applicants: Kiyoshi Hata, Tokyo (JP); Keisuke Sugiyama, Tokyo (JP); Tomomichi Hoshino, Kanagawa (JP); Atsushi Kikuchi, Kanagawa (JP); Satoshi Saito, Kanagawa (JP); Makoto Hidaka, Tokyo (JP); Takuya Sano, Kanagawa (JP); Takao Watanabe, Kanagawa (JP); Shohichi Satoh, Kanagawa (JP)

(72) Inventors: Kiyoshi Hata, Tokyo (JP); Keisuke Sugiyama, Tokyo (JP); Tomomichi Hoshino, Kanagawa (JP); Atsushi Kikuchi, Kanagawa (JP); Satoshi Saito, Kanagawa (JP); Makoto Hidaka, Tokyo (JP); Takuya Sano, Kanagawa (JP); Takao Watanabe, Kanagawa (JP); Shohichi Satoh, Kanagawa (JP)

(73) Assignee: Ricoh Company, LTD., Tokyo (JP)

( * ) Notice: Subject to any disclaimer, the term of this patent is extended or adjusted under 35 U.S.C. 154(b) by 0 days.

(21) Appl. No.: 14/151,955

(22) Filed: Jan. 10, 2014

(65) Prior Publication Data

US 2014/0206516 A1 Jul. 24, 2014

(30) Foreign Application Priority Data

Jan. 18, 2013 (JP) ..... 2013-007078
Nov. 1, 2013 (JP) ..... 2013-228148

(51) Int. Cl.

| | |
|---|---|
| ***B65H 45/18*** | (2006.01) |
| ***B31F 1/00*** | (2006.01) |
| ***B65H 45/04*** | (2006.01) |

(Continued)

(52) U.S. Cl.

CPC *B65H 45/18* (2013.01); *B31F 1/00* (2013.01); *B31F 1/0006* (2013.01); *B31F 1/0035* (2013.01); *B65H 37/04* (2013.01); *B65H 45/04* (2013.01); *B65H 45/12* (2013.01); *B65H 2301/51232* (2013.01); *B65H 2701/13212* (2013.01); *B65H 2801/27* (2013.01)

(58) Field of Classification Search

CPC ..... B31F 1/00; B31F 1/006; B31F 1/0035; B65H 45/12; B65H 45/04; B65H 2801/27
USPC ..... 270/32, 45, 58.07
See application file for complete search history.

(56) References Cited

U.S. PATENT DOCUMENTS

| | | | | |
|---|---|---|---|---|
| 7,285,084 | B2 * | 10/2007 | Fujimoto et al. | 270/45 |
| 7,336,921 | B2 * | 2/2008 | Suzuki et al. | 399/407 |
| 7,922,162 | B2 | 4/2011 | Kamiya | |

(Continued)

FOREIGN PATENT DOCUMENTS

| | | |
|---|---|---|
| EP | 2 065 326 | 6/2009 |
| EP | 2 090 537 | 8/2009 |

(Continued)

OTHER PUBLICATIONS

U.S. Office Action dated Sep. 30, 2014 for co-pending U.S. Appl. No. 14/020,961.

(Continued)

*Primary Examiner* — Leslie A Nicholson, III
(74) *Attorney, Agent, or Firm* — Harness, Dickey & Pierce, P.L.C.

(57) ABSTRACT

A sheet processing apparatus includes a flexure forming unit configured to flex sheets to include a portion on which no fold line is formed in a direction orthogonal to a sheet conveying direction; a first pressing member pair configured to press a flexure portion of the flexed sheets to form a fold line thereon; and a moving unit configured to move a pressing position of the first pressing member pair in the direction orthogonal to the sheet conveying direction.

10 Claims, 20 Drawing Sheets

(51) Int. Cl.
*B65H 45/12* (2006.01)
*B65H 37/04* (2006.01)

(56) References Cited

U.S. PATENT DOCUMENTS

| | | | |
|---|---|---|---|
| 7,950,643 | B2 | 5/2011 | Kawaguchi |
| 8,083,218 | B2 | 12/2011 | Dobashi et al. |
| 8,432,497 | B2 | 4/2013 | Lee et al. |
| 2008/0315481 | A1 | 12/2008 | Iguchi et al. |
| 2008/0315482 | A1 | 12/2008 | Iguchi et al. |
| 2008/0315483 | A1 | 12/2008 | Iguchi et al. |
| 2008/0315484 | A1 | 12/2008 | Iguchi et al. |
| 2008/0315485 | A1 | 12/2008 | Iguchi et al. |
| 2008/0315486 | A1 | 12/2008 | Iguchi et al. |
| 2008/0315487 | A1 | 12/2008 | Iguchi et al. |
| 2008/0315488 | A1 | 12/2008 | Iguchi et al. |
| 2009/0200725 | A1 | 8/2009 | Tamura et al. |
| 2010/0219575 | A1 | 9/2010 | Iguchi et al. |
| 2010/0239393 | A1 | 9/2010 | Suzuki et al. |
| 2010/0258994 | A1 | 10/2010 | Kikkawa et al. |
| 2010/0303585 | A1 | 12/2010 | Asami et al. |
| 2010/0310340 | A1 | 12/2010 | Suzuki et al. |
| 2011/0057375 | A1 | 3/2011 | Iguchi et al. |
| 2011/0064541 | A1 | 3/2011 | Kikkawa et al. |
| 2011/0091259 | A1 | 4/2011 | Kobayashi et al. |
| 2011/0103919 | A1 | 5/2011 | Furuhashi et al. |
| 2011/0103921 | A1 | 5/2011 | Suzuki et al. |
| 2011/0156333 | A1 | 6/2011 | Iguchi et al. |
| 2011/0176849 | A1 | 7/2011 | Abe |
| 2011/0181917 | A1 | 7/2011 | Iguchi et al. |
| 2011/0229287 | A1 | 9/2011 | Suzuki |
| 2011/0278784 | A1 | 11/2011 | Iguchi et al. |
| 2012/0027428 | A1 | 2/2012 | Terao |
| 2012/0087765 | A1 | 4/2012 | Suzuki |

FOREIGN PATENT DOCUMENTS

| | | |
|---|---|---|
| JP | 2003-341930 | 12/2003 |
| JP | 2007-45531 | 2/2007 |
| JP | 2009-001428 | 1/2009 |
| JP | 2009-190824 | 8/2009 |

OTHER PUBLICATIONS

Extended European Search Report dated Dec. 20, 2013.

* cited by examiner

SHEET PROCESSING APPARATUS AND IMAGE FORMING SYSTEM

CROSS-REFERENCE TO RELATED APPLICATIONS

The present application claims priority to and incorporates by reference the entire contents of Japanese Patent Application No. 2013-007078 filed in Japan on Jan. 18, 2013 and Japanese Patent Application No. 2013-228148 filed in Japan on Nov. 1, 2013.

BACKGROUND OF THE INVENTION

1. Field of the Invention

The present invention relates to a sheet processing apparatus and an image forming system.

2. Description of the Related Art

A type of the sheet processing apparatus that performs folding processing on sheets including images formed by an image forming apparatus has been known. A sheet processing apparatus described in Japanese Laid-open Patent Publication No. 2003-341930 includes a folding plate that pushes a sheet surface of a sheet bundle having a plurality of sheets bundled at a folding position in a direction orthogonal to the sheet surface using an end of the folding plate, and a pair of folding rollers (hereinafter, "folding roller pair") that are arranged to face each other across a transfer path of the folding plate and that sandwich the sheet bundle. The sheet surface is pushed by the folding plate to a sheet folding part and then the sheet bundle is conveyed with opposite side surfaces of the sheets at the folding position sandwiched by the folding roller pair, thereby folding the sheet bundle.

Furthermore, one additional folding roller provided downstream of a sheet conveying direction with respect to the folding roller pair moves on the sheet bundle having one fold line formed thereon in a direction of the fold line while applying a pressure on the fold line of the sheet bundle, thereby additionally folding the sheet bundle.

However, the folding roller pair is configured to have a width larger than a sheet width and to hold the entire region of the sheet bundle in a sheet width direction. Additional folding processing performed by the additional folding roller is often performed near the folding roller pair because of a space in the apparatus. Accordingly, the sheet bundle is in a state being held by the folding roller pair when additional folding is performed by the additional folding roller.

A fold line portion of the sheet bundle entering a nip part of the additional folding roller only slightly protrudes from a nip part of the folding roller pair. The sheet bundle having passed through the nip part of the folding roller pair tends to expand at the fold line due to firmness of the sheets. However, because a distance between the fold line of the sheet bundle and the folding roller pair is short and the sheets are held by the folding roller pair, the fold line of the sheet bundle hardly expands. Therefore, there are almost no gaps between adjacent sheets, respectively, at the fold line of the sheet bundle and the sheets are closely superposed one on top of another.

Basically, folding of a sheet is achieved by deforming the sheet and breaking fibers of the sheet to form a crease on the sheet. Therefore, when the sheets are closely superposed one on top of another at the fold line of the sheet bundle, spaces for deforming the sheets are not provided between adjacent sheets, respectively, at the fold line. Accordingly, the sheets are hardly deformed even when additional folding is performed, so that a firm crease cannot be formed at the fold line. Furthermore, because the single additional folding roller applies a pressure on the fold line of the sheet bundle, there is still one fold line in the sheet bundle after the additional folding, which prevents a folded height of the sheet bundle from being sufficiently reduced.

Therefore, there is a need to provide a sheet processing apparatus that can reduce a folded height of a sheet bundle and an image forming system including the sheet processing apparatus.

SUMMARY OF THE INVENTION

It is an object of the present invention to at least partially solve the problems in the conventional technology.

According to an embodiment, there is provided a sheet processing apparatus that includes a flexure forming unit configured to flex sheets to include a portion on which no fold line is formed in a direction orthogonal to a sheet conveying direction; a first pressing member pair configured to press a flexure portion of the flexed sheets to form a fold line thereon; and a moving unit configured to move a pressing position of the first pressing member pair in the direction orthogonal to the sheet conveying direction.

According to another embodiment, there is provided an image forming system that includes an image forming apparatus configured to form images on sheets, respectively; a sheet processing apparatus configured to perform a folding process on the sheets each having the image formed by the image forming apparatus; and the sheet processing apparatus according to the above embodiment.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 2:
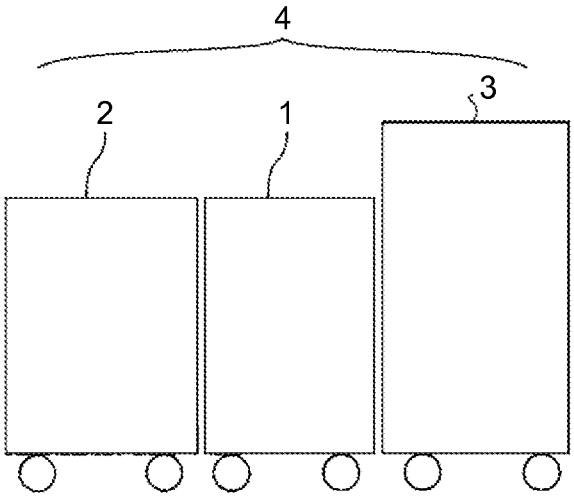
FIG. 2 illustrates a system configuration of an image forming system according to an embodiment of the present invention.

FIG. 2 illustrates a system configuration of an image forming system 4 including an image forming apparatus 3 and a plurality of sheet processing apparatuses according to an embodiment of the present invention. In the present embodiment, a sheet bundling apparatus 1 as a first sheet post-processing apparatus and a saddle-stitch binding apparatus 2 as a second sheet post-processing apparatus are provided in this order at the subsequent stage of the image forming apparatus 3.

The image forming apparatus 3 forms an image on a sheet based on input image data or image data of a read image. For example, the image forming apparatus 3 corresponds to a copying machine, a printer, a facsimile, or a digital multifunction printer including at least two of these functions. The image forming apparatus 3 is of a known method such as an electrophotographic method or a liquid droplet injection method and can adopt any image forming method. In the present embodiment, a copying machine of the electrophotographic method is used.

Figure 3:
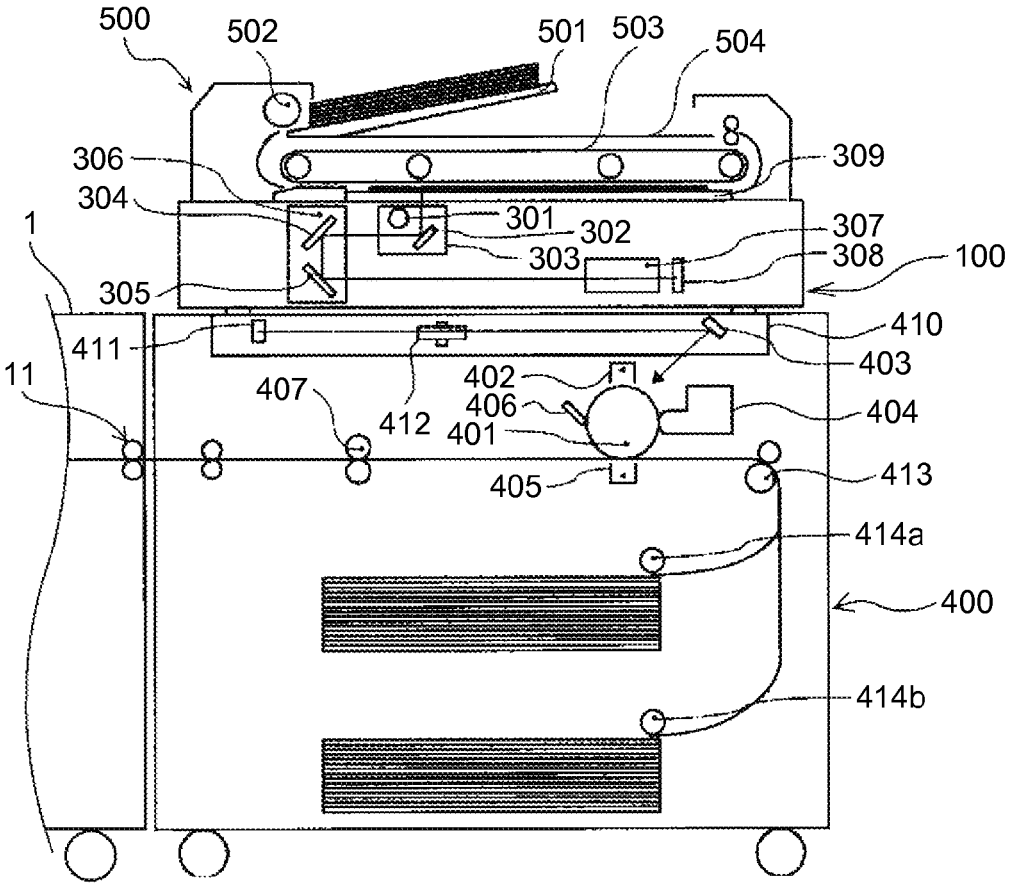
FIG. 3 is an explanatory diagram of an image forming apparatus.

FIG. 3 is an explanatory diagram of the image forming apparatus 3.

An image forming apparatus body 400 has a feeding cassette that holds sheets as recording media therein arranged below an image forming part. Each of the sheets held in the feeding cassette is fed by a feeding roller 414*a* or 414*b* and then conveyed upward along a predetermined conveying path to reach a registration roller pair 413.

The image forming part includes a photoreceptor drum 401 serving as an image carrying body, a charging device 402, an exposing device 410, a developing device 404, a transfer device 405, and a cleaning device 406.

The charging device 402 is a charging unit that uniformly charges a surface of the photoreceptor drum 401. The exposing device 410 is a latent-image forming unit that forms a latent image on the photoreceptor drum 401 based on image information read by an image reading device 100. The developing device 404 is a developing unit that attaches toner on the latent image on the photoreceptor drum 401 to obtain a visible image. The transfer device 405 is a transfer unit that transfers a toner image on the photoreceptor drum 401 to a sheet. The cleaning device 406 is a cleaning unit that removes toner remaining on the photoreceptor drum 401 after transfer.

A fixing device 407 as a fixing unit that fixes the toner image on a sheet is placed downstream in a sheet conveying direction of the image forming part.

The exposing device 410 includes a laser unit 411 that emits laser light according to the image information under a control of a control part (not illustrated), and a polygon mirror 412 that scans the laser light from the laser unit 411 in a rotational axis direction (a main-scanning direction) of the photoreceptor drum 401.

An automatic original-conveying device 500 is connected to an upper portion of the image reading device 100. The automatic original-conveying device 500 includes an original table 501, an original separating/feeding roller 502, a conveying belt 503, and an original discharge tray 504.

When an original is set on the original table 501 and a reading start instruction is received, the automatic original-conveying device 500 feeds the original on the original table 501 one sheet by one sheet using the original separating/feeding roller 502. The original is guided by the conveying belt 503 onto a platen glass 309 and temporarily stops thereon.

Image information of the original temporarily stopping on the platen glass 309 is read by the image reading device 100. Conveying the original is then resumed by the conveying belt 503 and the original is discharged to the original discharge tray 504.

An image reading operation and an image forming operation are explained next.

When an original is conveyed by the automatic original-conveying apparatus 500 onto the platen glass 309 or placed by a user on the platen glass 309 and then a copy start operation is performed on an operation panel (not illustrated), a light source 301 on a first traveling body 303 is turned on. In conjunction therewith, the first traveling body 303 and a second traveling body 306 are moved along a guide rail (not illustrated).

Light from the light source 301 is applied to the original on the platen glass 309 and light reflected thereon is guided to a mirror 302 on the first traveling body 303, mirrors 304 and 305 on the second traveling body 306, and a lens 307 to be received by a charge-coupled device (CCD) 308. This enables the CCD 308 to read image information of the original and the image information is converted by an analog/digital (A/D) converting circuit (not illustrated) from analog data to digital data. The image information is transmitted from an information output part (not illustrated) to the control part of the image forming apparatus body 400.

Meanwhile, the image forming apparatus body 400 starts driving the photoreceptor drum 401 and, when the photoreceptor drum 401 rotates at a predetermined speed, the charging device 402 uniformly charges the surface of the photoreceptor drum 401. A latent image based on the image information read by the image reading device is formed on the charged surface of the photoreceptor drum 401 by the exposing device 410.

The latent image on the surface of the photoreceptor drum 401 is then developed by the developing device 404 to obtain a toner image. Each of the sheets held in the feeding cassette is fed by the feeding roller 414*a* or 414*b* and is temporarily stopped on the registration roller pair 413.

The sheet is then sent to a transfer part facing the transfer device 405 by the registration roller pair 413 at a timing when an end portion of the toner image formed on the surface of the photoreceptor drum 401 reaches the transfer part. When the sheet passes through the transfer part, the toner image formed on the surface of the photoreceptor drum 401 is transferred on the sheet due to an action of a transfer electric field.

The sheet having the toner image mounted thereon is then conveyed to the fixing device 407, subjected to a fixing process by the fixing device 407, and then discharged to a sheet bundling apparatus 1 at the subsequent stage. Transfer residual toner that is not transferred on the sheet at the transfer part and remains on the surface of the photoreceptor drum 401 is removed by the cleaning device 406.

Figure 4:
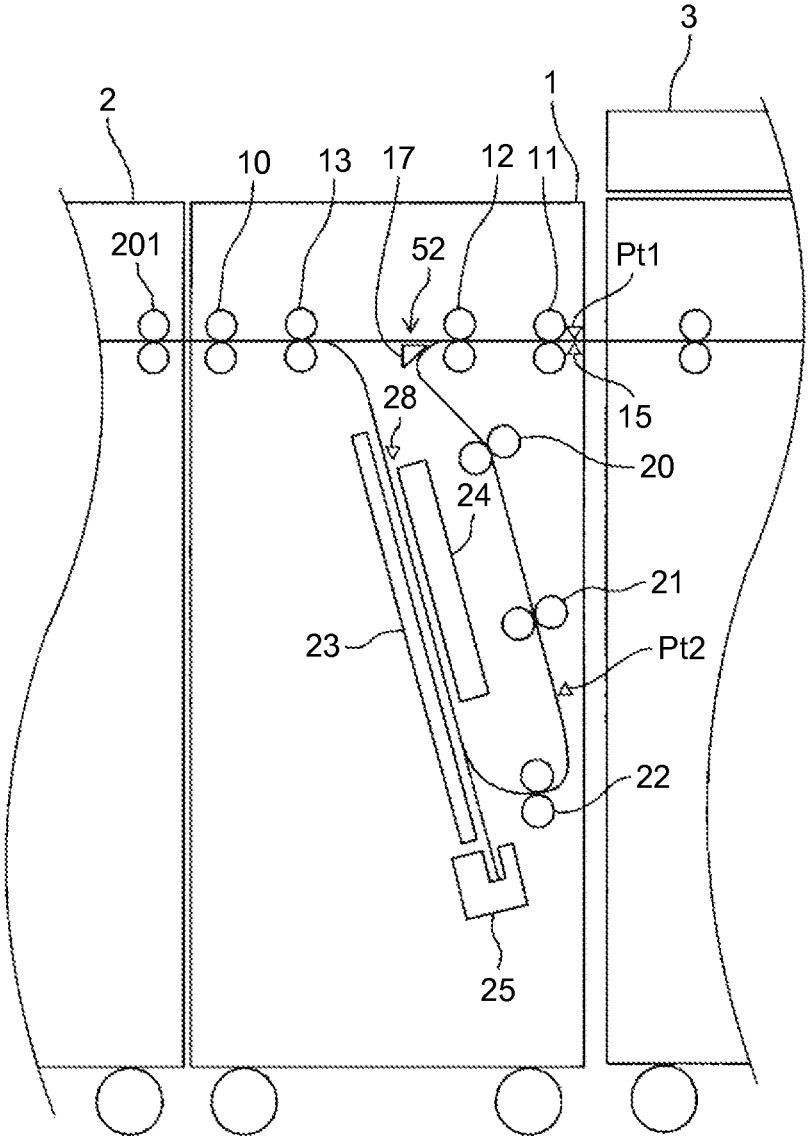
FIG. 4 is an explanatory diagram of a sheet bundling apparatus.

FIG. 4 is an explanatory diagram of the sheet bundling apparatus 1.

The sheet bundling apparatus 1 is a sheet post-processing apparatus having a sheet-bundle creating function to receive sheets one by one from the image forming apparatus 3, sequentially superpose the sheets, and array the sheets to create a sheet bundle SB.

A conveying path Pt1 for receiving the sheets discharged from the image forming apparatus 3 and discharging the sheets to the saddle-stitch binding apparatus 2 at a rear end without performing any processing on the sheets is provided in the sheet bundling apparatus 1. A conveying path Pt2 that bifurcates from the conveying path Pt1 to bundle the sheets is also provided. Each of the conveying paths Pt1 and Pt2 is formed by a guide member (not illustrated), for example.

On the conveying path Pt1, an entrance roller pair 11, conveying roller pairs 12 and 13, and a discharge roller pair 10 are arranged in this order from upstream in a sheet conveying direction of the conveying path Pt1 to downstream in the sheet conveying direction.

In the following explanations, upstream in the sheet conveying direction is also referred to simply as "upstream" and downstream in the sheet conveying direction is also referred to simply as "downstream".

The entrance roller pair 11, the conveying roller pairs 12 and 13, and the discharge roller pair 10 are rotationally driven by motors (not illustrated), respectively, and convey the sheets.

An entrance sensor 15 is placed upstream in the sheet conveying direction of the entrance roller pair 11. The entrance sensor 15 detects that a sheet is conveyed into the sheet bundling apparatus 1. A rotatable bifurcating claw 17 driven, for example, by a motor or a solenoid is placed downstream in the sheet conveying direction of the conveying roller pair 12. The bifurcating claw 17 rotationally moves to switch the position, thereby selectively guiding the sheet to either a portion of the conveying path Pt1 upstream in the sheet conveying direction of the bifurcating claw 17 or the conveying path Pt2.

In a discharge mode, the sheets conveyed from the image forming apparatus 3 into the conveying path Pt1 are conveyed by the entrance roller pair 11, the conveying roller pairs 12 and 13, and the discharge roller pair 10 and discharged to the saddle-stitch binding apparatus 2 at the subsequent stage.

In a sheet bundling mode, the sheets conveyed into the conveying path Pt1 are conveyed by the entrance roller pair 11 and the conveying roller pair 12, changed in the traveling direction by the bifurcating claw 17, and conveyed into the conveying path Pt2.

Conveying roller pairs 20, 21, and 22, a sheet accumulating tray 23, a jogger fence 24, a rear-end reference fence 25, and the like are placed on the conveying path Pt2. The conveying roller pairs 20, 21, and 22 and the jogger fence 24 are driven by motors (not illustrated), respectively.

The sheets conveyed into the conveying path Pt2 are sequentially accumulated on the sheet accumulating tray 23. This forms a sheet bundle having a plurality of sheets stacked. At that time, positions in the sheet conveying direction of the sheets in the sheet bundle are aligned by a movable reference fence (not illustrated) provided on the sheet accumulating tray 23 and the rear-end reference fence 25, and positions in a width direction thereof are aligned by the jogger fence 24. The movable reference fence is driven by a motor.

The sheet accumulating tray 23, the jogger fence 24, the rear-end reference fence 25, and the movable reference fence constitute a bundling part 28 as a bundling part that superposes plural sheets to form a sheet bundle. The bundling part 28 includes the motor that drives the jogger fence 24 and the motor that drives the movable reference fence.

The sheet bundle formed by the bundling part 28 is conveyed into the conveying path Pt1 by the movable reference fence and then discharged by the conveying roller pair 13 and the discharge roller pair 10 to the saddle-stitch binding apparatus 2 at the subsequent stage.

Figure 5:
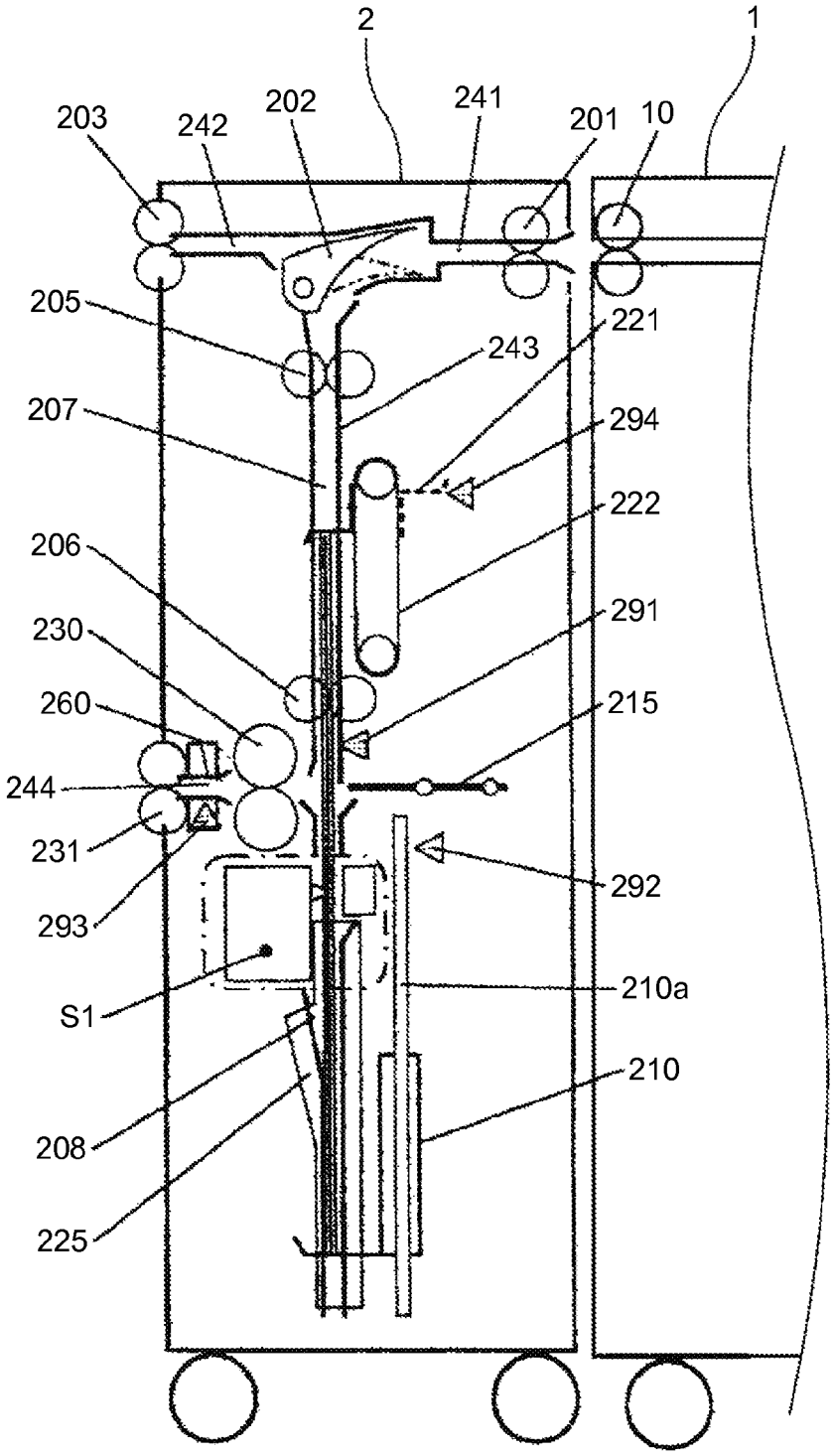
FIG. 5 is an explanatory diagram of a saddle-stitch binding apparatus.

FIG. 5 is an explanatory diagram of the saddle-stitch binding apparatus 2. The saddle-stitch binding apparatus 2 receives the sheet bundle SB discharged from the sheet bundling apparatus 1 and performs a saddle stitching process or a center folding process for the sheet bundle SB.

The saddle-stitch binding apparatus 2 includes an entrance conveying path 241, a sheet-through conveying path 242, a center-folding conveying path 243, and the like. An entrance roller pair 201 is provided at a most upstream part in the sheet conveying direction of the entrance conveying path 241 and the sheet bundle SB discharged from the discharge roller pair 10 of the sheet bundling apparatus 1 is conveyed by the entrance roller pair 201 into the saddle-stitch binding apparatus 2.

A bifurcating claw 202 is rotatably provided downstream of the entrance roller pair 201 in the entrance conveying path 241. The bifurcating claw 202 is installed in a horizontal direction in FIG. 5 and bifurcates a conveying direction of the sheet bundle SB into the sheet-through conveying path 242 and the center-folding conveying path 243.

The sheet-through conveying path 242 extends horizontally from the entrance conveying path 241 and guides the sheet bundle SB to a discharge tray (not illustrated) or a sheet processing apparatus (not illustrated) at the subsequent stage. The sheet bundle SB conveyed on the sheet-through conveying path 242 is discharged to the discharge tray or the sheet processing apparatus at the subsequent stage by upper discharge rollers 203.

The center-folding conveying path 243 extends vertically downward from the position of the bifurcating claw 202 and is for performing the saddle stitching process, the center folding process, or the like for the sheet bundle SB.

A folding plate 215 that centrally folds the sheet bundle SB is provided on the center-folding conveying path 243. An upper sheet-bundle conveying-guide plate 207 that guides the sheet bundle SB above the folding plate 215, a lower sheet-bundle conveying-guide plate 208 that guides the sheet bundle SB below the folding plate 215, and the like are also provided.

Upper sheet-bundle conveying rollers 205, a rear-end beating claw 221, and lower sheet-bundle conveying rollers 206 are provided in this order from the top on the upper sheet-bundle conveying-guide plate 207.

The rear-end beating claw 221 is provided to stand on a rear-end beating-claw drive belt 222 that is driven by a drive motor (not illustrated). The rear-end beating claw 221 performs an operation of beating (pressing) rear ends of the sheet bundle SB toward a movable fence (explained later) by a reciprocal rotation operation of the rear-end beating-claw drive belt 222, thereby performing an arraying operation of the sheet bundle SB. When the sheet bundle SB is conveyed or the sheet bundle SB is raised for center folding, the rear-end beating claw 221 retracts from the center-folding conveying path 243 (a broken line position in FIG. 5).

A rear-end beating-claw home-position sensor 294 is for detecting a home position of the rear-end beating claw 221 and detects the broken line position in FIG. 5 (a solid line position in FIG. 6) of the rear-end beating claw 221 retracted from the center-folding conveying path 243 as the home position. The rear-end beating claw 221 is controlled based on this home position.

A saddle stitching stapler S1, a pair of saddle-stitching jogger fences 225, and a movable fence 210 are provided in this order from the top on the lower sheet-bundle conveying-guide plate 208.

The lower sheet-bundle conveying-guide plate 208 receives the sheet bundle SB conveyed through the upper sheet-bundle conveying-guide plate 207. The saddle-stitching jogger fences 225 are provided in a width direction of the lower sheet-bundle conveying-guide plate 208 and the movable fence 210 that is movable in upper and lower directions and on which a sheet bundle end abuts is provided in a lower part of the lower sheet-bundle conveying-guide plate 208.

The saddle stitching stapler S1 is a stitching tool that stitches a central portion of the sheet bundle SB. The movable fence 210 moves in the upper and lower directions in a state where the end of the sheet bundle SB abuts thereon and locates the central portion of the sheet bundle SB at a position to face the saddle stitching stapler S1. A stapling process, that is, saddle stitching is performed for the sheet bundle SB at that position.

The movable fence 210 is supported by a movable-fence drive mechanism **210*a* and is capable of moving between an upper position corresponding to a movable-fence home-position sensor 292 of the movable-fence drive mechanism 210*a* and a lowermost position of the movable-fence drive mechanism 210*a***.

A movable range of the movable fence 210 on which the end of the sheet bundle SB abuts ensures a processable range of the sheet bundle SB from a maximum size to a minimum size that can be processed by the saddle-stitch binding apparatus 2. For example, a rack-and-pinion mechanism is used as the movable-fence drive mechanism **210*a***.

The folding plate 215, a folding roller pair 230, an additional-folding roller unit 260, lower discharge rollers 231, and the like are provided between the upper sheet-bundle conveying-guide plate 207 and the lower sheet-bundle conveying-guide plate 208, that is, at a roughly central portion of the center-folding conveying path 243.

An upper additional folding roller **261*a* and a lower additional folding roller 262*a* (illustrated in FIG. 11) that constitutes a pair of rollers are provided in the additional-folding roller unit 260 across a discharge conveying path between the folding roller pair 230 and the lower discharge rollers 231**.

The folding plate 215 can reciprocate in the horizontal direction in FIG. 5. Nips of the folding roller pair 230 are located downstream in a movement direction of the folding plate 215 during a folding operation and a discharge conveying path 244 is provided as an extension thereof.

The lower discharge rollers 231 are provided most downstream of the discharge conveying path 244 and discharge the folded sheet bundle SB to the subsequent stage.

A sheet-bundle detecting sensor 291 is provided on a lower end side of the upper sheet-bundle conveying-guide plate 207 and detects an end of the sheet bundle SB conveyed into the center-folding conveying path 243 and passing through a center folding position. A fold-line-portion pass sensor 293 is provided on the discharge conveying path 244 and detects an end of the centrally-folded sheet bundle SB to recognize pass of the sheet bundle SB.

In the saddle-stitch binding apparatus 2 configured as illustrated in FIG. 5, the saddle stitching operation and the center folding operation are performed as illustrated in operation explanatory diagrams of FIGS. 6 to 10. That is, when saddle stitching and center folding is selected on the operation panel (not illustrated) of the image forming apparatus 3, the sheet bundle SB for which saddle stitching and center folding is selected is guided from the entrance conveying path 241 to the center-folding conveying path 243 by a rotational movement operation of the bifurcating claw 202 in a counterclockwise direction in FIG. 5. While the bifurcating claw 202 is driven by a solenoid in the present embodiment, the bifurcating claw 202 can be driven by a motor instead of the solenoid.

Figure 6:
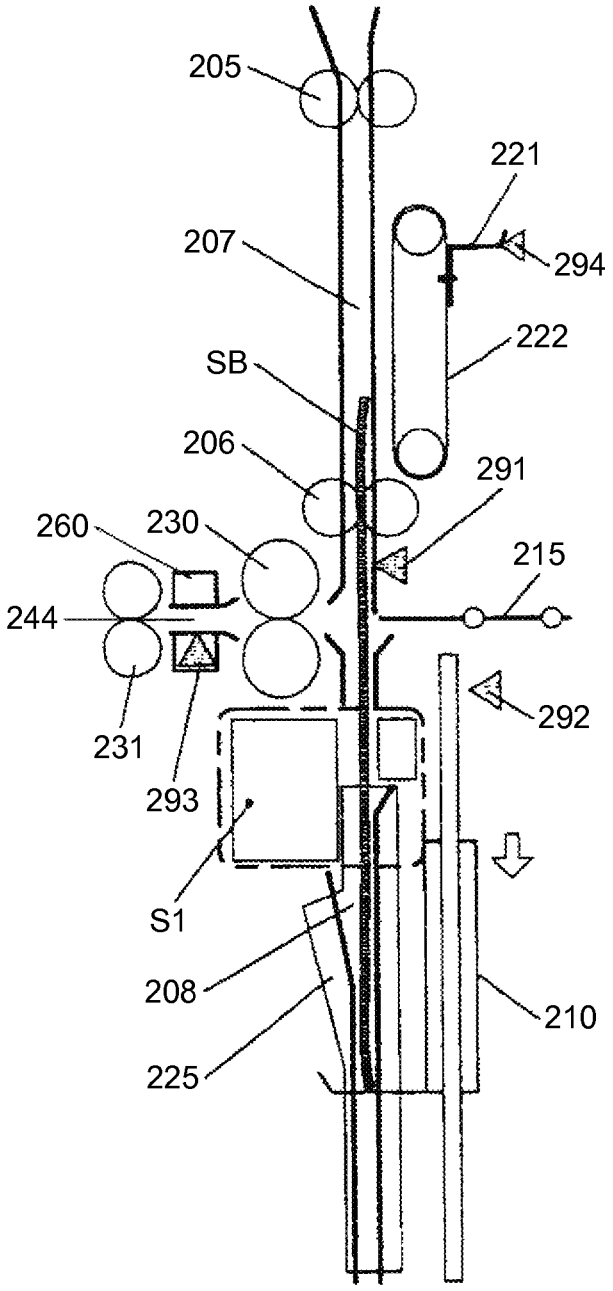
FIG. 6 is an operation explanatory diagram of the saddle-stitch binding apparatus, illustrating a state where a sheet bundle is conveyed into a center-folding conveying path.

The sheet bundle SB conveyed into the center-folding conveying path 243 is conveyed downward on the center-folding conveying path 243 by the entrance roller pair 201 and the upper sheet-bundle conveying rollers 205. After pass of an end of the sheet bundle SB is confirmed by the sheet-bundle detecting sensor 291, the sheet bundle SB is conveyed by the lower sheet-bundle conveying rollers 206 to a position where the end of the sheet bundle SB abuts on the movable fence 210 as illustrated in FIG. 6.

Meanwhile, the movable fence 210 waits at a stop position differing according to sheet size information from the image forming apparatus 3, information of a size of each sheet bundle SB in the conveying direction in this example. At that time, in FIG. 6, the lower sheet-bundle conveying rollers 206 hold the sheet bundle SB sandwiched with nips and the rear-end beating claw 221 waits at the home position.

Figure 7:
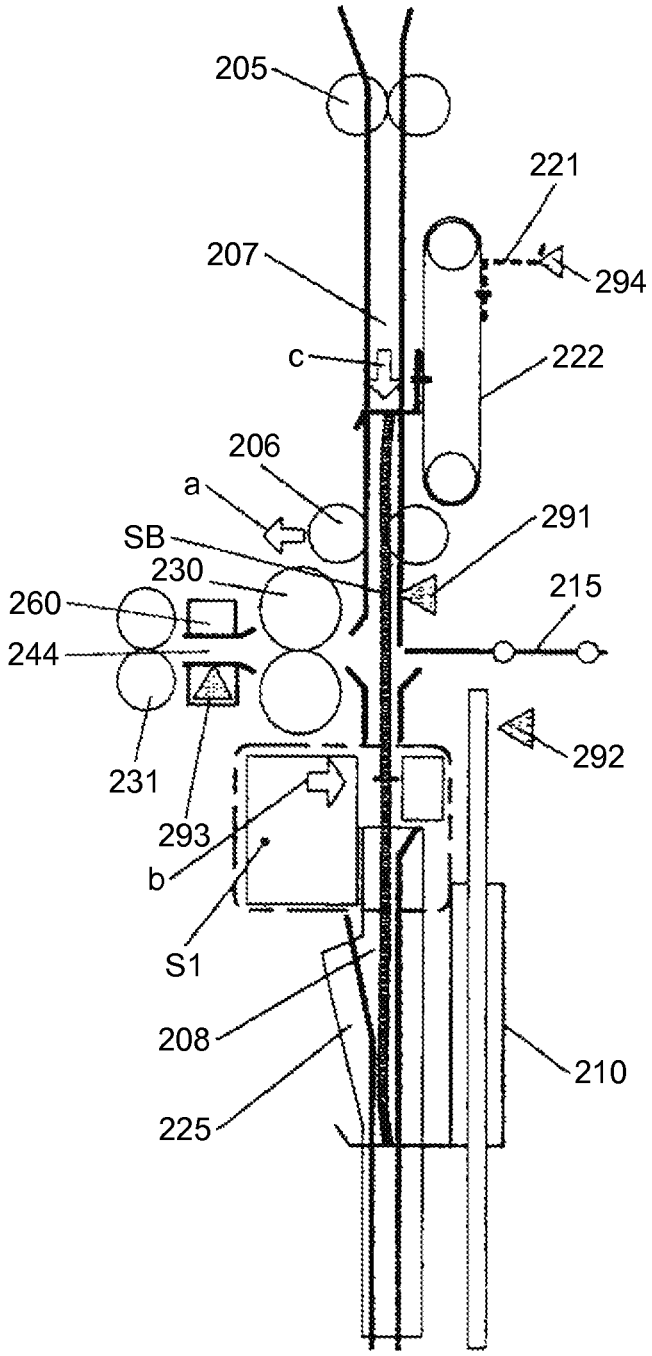
FIG. 7 is an operation explanatory diagram of the saddle-stitch binding apparatus, illustrating a state where a sheet bundle is saddle-stitched.

In this state, as illustrated in FIG. 7, sandwiching by the lower sheet-bundle conveying rollers 206 is released (in a direction of an arrow "a" in FIG. 7), the end of the sheet bundle SB abuts on the movable fence 210, and the sheet bundle SB is stacked in a state where the rear end of the sheet bundle SB is free. The rear-end beating claw 221 is then driven and the rear-end beating claw 221 beats the rear end of the sheet bundle SB, thereby definitively aligning the sheet bundle SB in the conveying direction (in a direction of an arrow c in FIG. 7).

An alignment operation of the sheet bundle SB in the width direction (a direction orthogonal to the sheet conveying direction) is then performed by the saddle-stitching jogger fences 225. In this way, the alignment operations in the width direction and in the conveying direction are performed for the sheet bundle SB to complete the arraying operation of the sheet bundle SB in the width direction and in the conveying direction. At that time, the arraying operation is performed by changing amounts of pressing by the rear-end beating claw 221 and the saddle-stitching jogger fences 225 to appropriate values, respectively, based on size information of the sheets, information of the number of sheets in the sheet bundle SB, sheet-bundle thickness information, and the like.

Because a space in the center-folding conveying path 243 is reduced as the sheet bundle SB increases in the thickness, there are many cases where the sheet bundle SB cannot be arrayed in one arraying operation. In such cases, the number of times of arraying of the sheet bundle SB is increased. In this way, a better arraying state can be realized.

A time required to sequentially superpose plural sheets to form the sheet bundle SB in the sheet bundling apparatus 1 provided at the previous stage of the saddle-stitch binding apparatus 2 increases as the number of sheets increases. Accordingly, a time until the saddle-stitch binding apparatus 2 receives the next sheet bundle SB from the sheet bundling apparatus 1 also increases. As a result, even when the number of times of arraying of the sheet bundle SB in the saddle-stitch binding apparatus 2 increases, there is no time loss in the system and thus a satisfactory arraying state can be efficiently realized. Therefore, the number of times of arraying of the sheet bundle SB performed in the saddle-stitch binding apparatus 2 can be controlled also according to a processing time spent at the previous stage of the saddle-stitch binding apparatus 2, such as in the sheet bundling apparatus 1.

The waiting position of the movable fence 210 is usually set at such a position that a saddle stitching position of the sheet bundle SB faces a stitching position of the saddle stitching stapler S1. This is because, when the sheet bundle SB is arrayed at this position, the stitching process can be performed at the position where the sheet bundle SB is stacked in the center-folding conveying path 243 without moving the movable fence 210 to the saddle stitching position of the sheet bundle SB. A stitcher (not illustrated) of the saddle stitching stapler S1 is then moved in a direction of an arrow b in FIG. 7 to a central portion of the sheet bundle SB at the waiting position, thereby performing the stitching process with a clincher (not illustrated), so that the sheet bundle SB is saddle-stitched.

The movable fence 210 is positioned under a pulse control of the movable-fence home-position sensor 292 and the rear-end beating claw 221 is positioned under a pulse control of the rear-end beating-claw home-position sensor 294. The positioning controls on the movable fence 210 and the rear-end beating claw 221 are executed by a central processing unit (CPU) of a control circuit (not illustrated) of the saddle-stitch binding apparatus 2.

Figure 8:
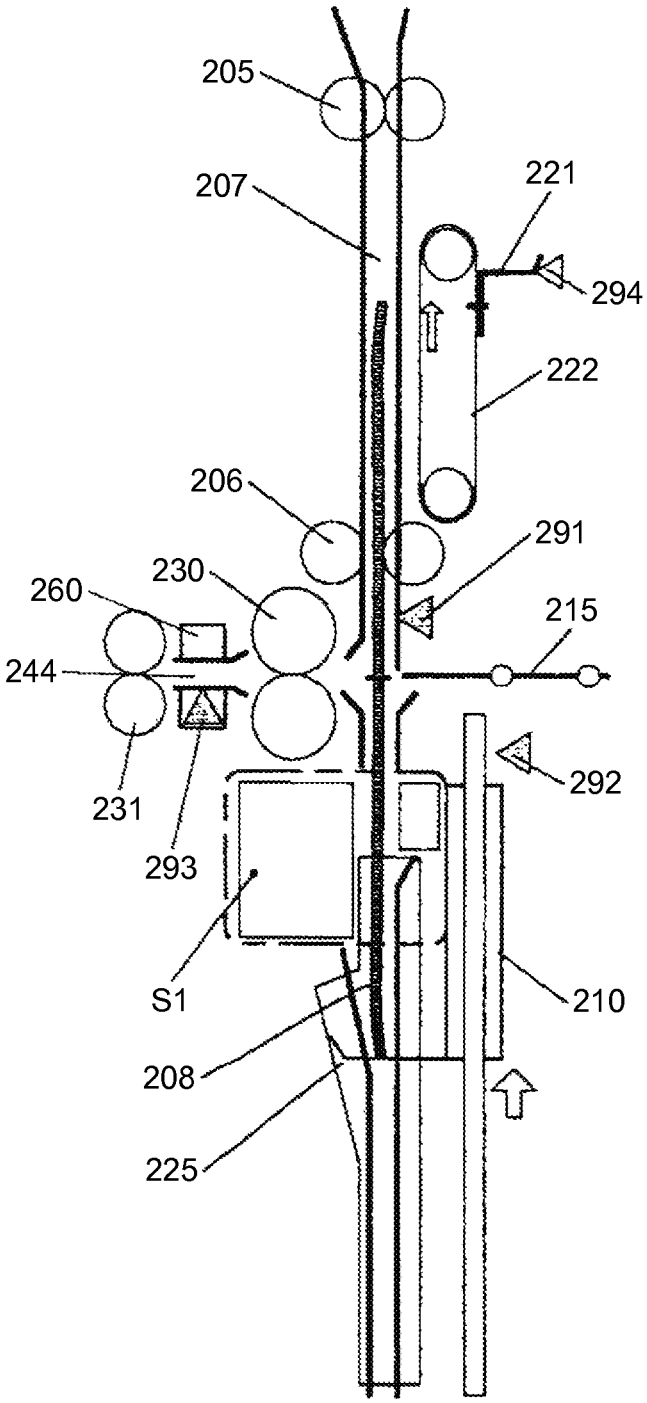
FIG. 8 is an operation explanatory diagram of the saddle-stitch binding apparatus, illustrating a state where a movement of a sheet bundle to a center folding position is completed.

The sheet bundle SB saddle-stitched in the state illustrated in FIG. 7 is conveyed to a position where the saddle stitching position faces the folding plate 215 along with an upward movement of the movable fence 210 in a state where sandwiching by the lower sheet-bundle conveying rollers 206 is released as illustrated in FIG. 8. This position is also controlled based on the detection position of the movable-fence home-position sensor 292. The saddle stitching position is a middle position of the sheet bundle SB in the conveying direction.

Figure 9:
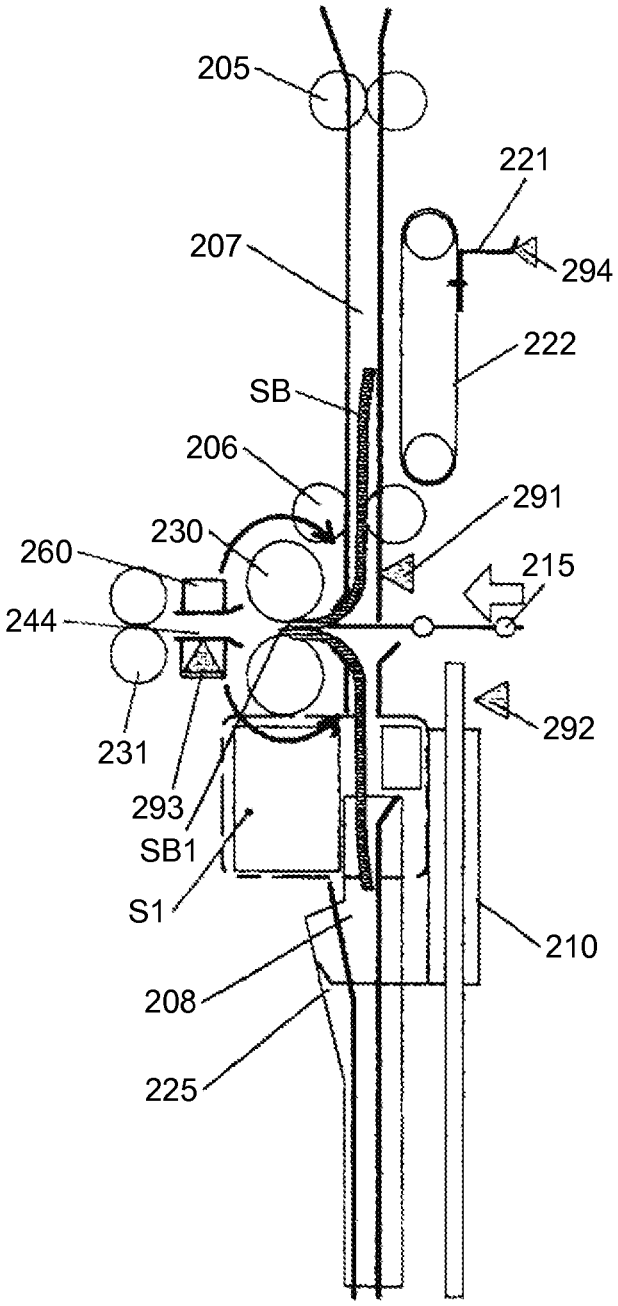
FIG. 9 is an operation explanatory diagram of the saddle-stitch binding apparatus, illustrating a state where a center folding process for a sheet bundle is performed.

When the sheet bundle SB reaches the position illustrated in FIG. 8, the folding plate 215 moves toward the nips of the folding roller pair 230 as illustrated in FIG. 9, abuts on the sheet bundle SB in a direction substantially orthogonal to a portion near a stitched needle, and pushes out the sheet bundle SB to the side of the nips of the folding roller pair 230.

The sheet bundle SB is pushed by the folding plate 215 to be guided to the nips of the folding roller pair 230 and is pushed into the nips of the folding roller pair 230 previously rotated. The folding roller pair 230 conveys the sheet bundle SB pushed into the nips while pressuring the sheet bundle SB. This pressurized conveying operation achieves folding on the center of the sheet bundle SB to simply bind the sheet bundle SB. FIG. 9 illustrates a state where an end of a fold line portion SB1 of the sheet bundle SB is sandwiched and pressurized at the nips of the folding roller pair 230.

Figure 10:
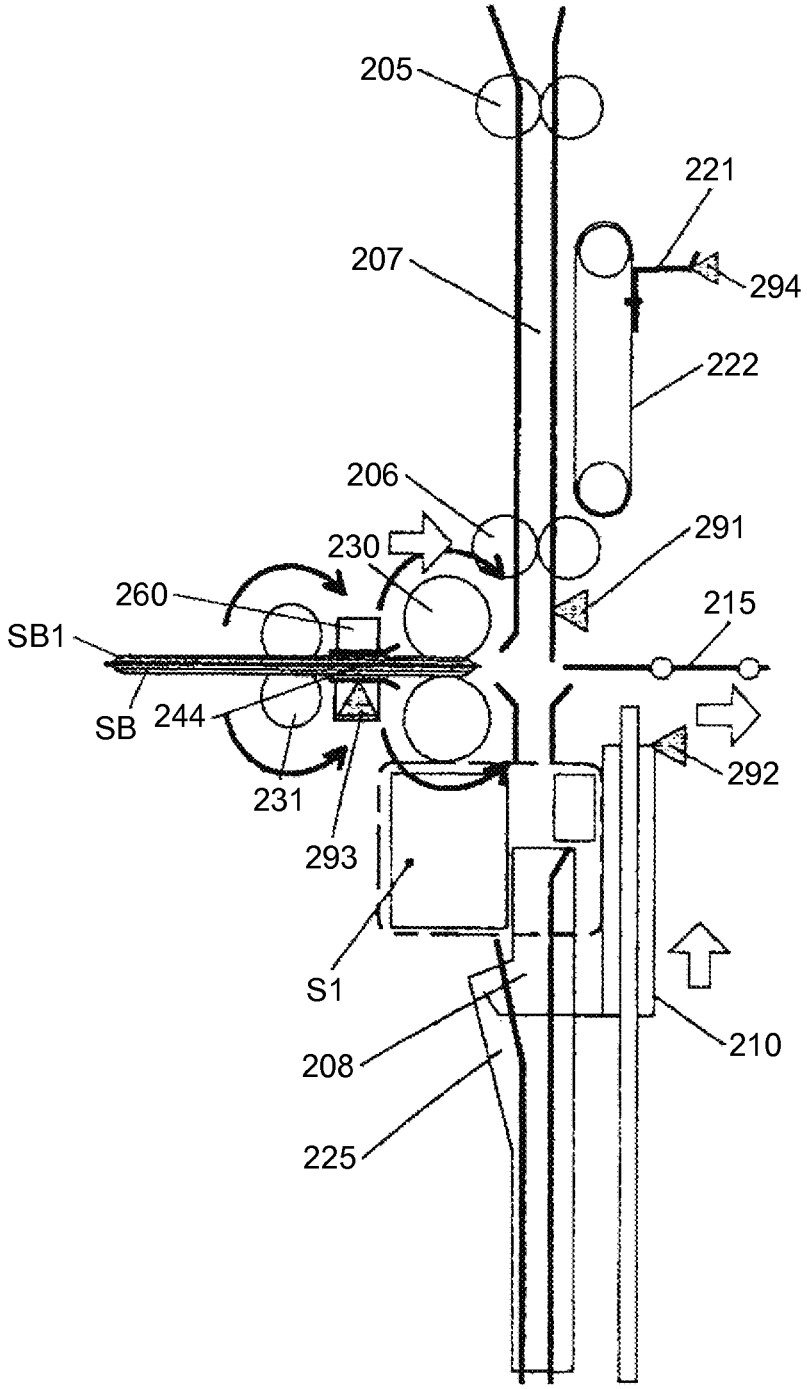
FIG. 10 is an operation explanatory diagram of the saddle-stitch binding apparatus, illustrating a state where a sheet bundle is discharged after performing the center folding process for a sheet bundle.

The sheet bundle SB folded in half at the central portion in the state illustrated in FIG. 9 is conveyed by the folding roller pair 230 as illustrated in FIG. 10, and further conveyed by the lower discharge rollers 231 to be discharge to the subsequent stage. At that time, when a rear end of the sheet bundle SB is detected by the fold-line-portion pass sensor 293, the folding plate 215 and the movable fence 210 return to the home positions and the lower sheet-bundle conveying rollers 206 return to the pressurizing state, thereby preparing for conveying the next sheet bundle SB.

When the sheet bundle SB in the next job is the same in size and the same in number, the movable fence 210 can be moved again to the position illustrated in FIG. 6 to wait at that position. These controls are also executed by the CPU of the control circuit.

Figure 11:
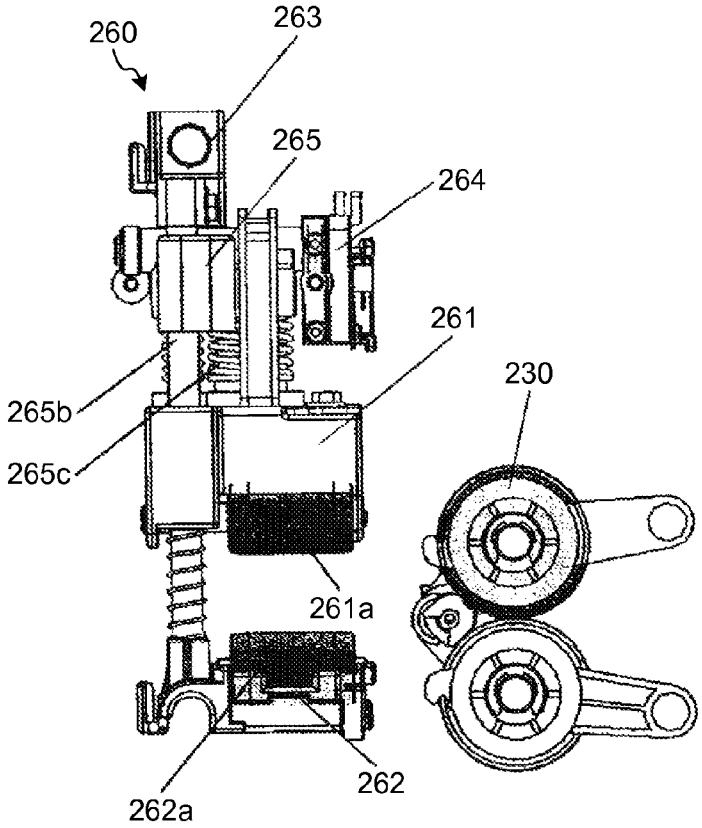
FIG. 11 is a front view of relevant parts of an additional-folding roller unit and a folding roller pair.
Figure 12:
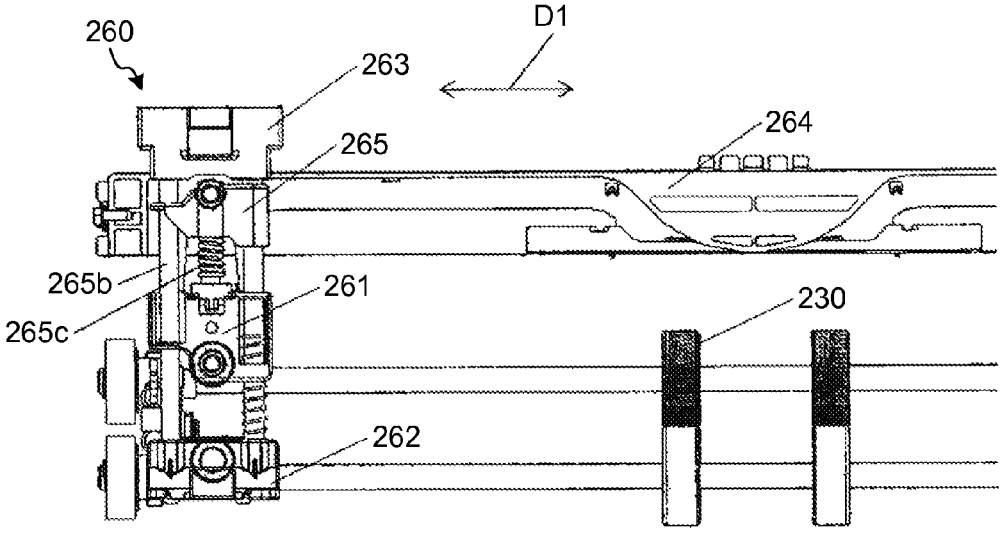
FIG. 12 is a side view of the relevant parts as viewed from the left in FIG. 11.

FIG. 11 is a front view of relevant parts of an additional-folding roller unit 260 and the folding roller pair 230 and FIG. 12 is a side view of the relevant parts as viewed from the left in FIG. 11.

The additional-folding roller unit 260 is installed on the discharge conveying path 244 between the folding roller pair 230 and the lower discharge rollers 231 and includes a unit moving mechanism 263, a guide member 264, a pressing mechanism 265, and the like.

The folding roller pair 230 has a skewered roller configuration in which a plurality of rollers are arranged with intervals between adjacent rollers in an axial direction.

The unit moving mechanism 263 reciprocally moves the additional-folding roller unit 260 along the guide member 264 using a drive source and a drive mechanism (not illustrated) in a depth direction in FIG. 11 (in a direction orthogonal to the sheet conveying direction).

The pressing mechanism 265 includes an additional-folding-roller upper unit 261 and an additional-folding-roller lower unit 262 and presses the sheet bundle SB by applying a pressure from above and below with the additional-folding-roller upper unit 261 and the additional-folding-roller lower unit 262.

The additional-folding-roller upper unit 261 is supported to the unit moving mechanism 263 by a support member 265*b* to be movable in upper and lower directions. The additional-folding-roller lower unit 262 is immovably attached to a lower end of the support member 265*b* of the pressing mechanism 265.

The upper additional folding roller 261*a* of the additional-folding-roller upper unit 261 can press against the lower additional folding roller 262*a* of the additional-folding-roller lower unit 262 to be brought into contact therewith and sandwiches the sheet bundle SB between nips thereof to pressurize the sheet bundle SB. A pressurizing force at that time is applied by a pressurizing spring 265*c* that pressurizes the additional-folding-roller upper unit 261 with an elastic force. The upper additional folding roller 261*a* moves in the width direction of the sheet bundle SB (a direction of an arrow D1 in FIG. 12) as described below to perform additional folding for the fold line portion SB1 in a state where the sheet bundle SB is pressurized by the pressing mechanism 265.

Figure 13:
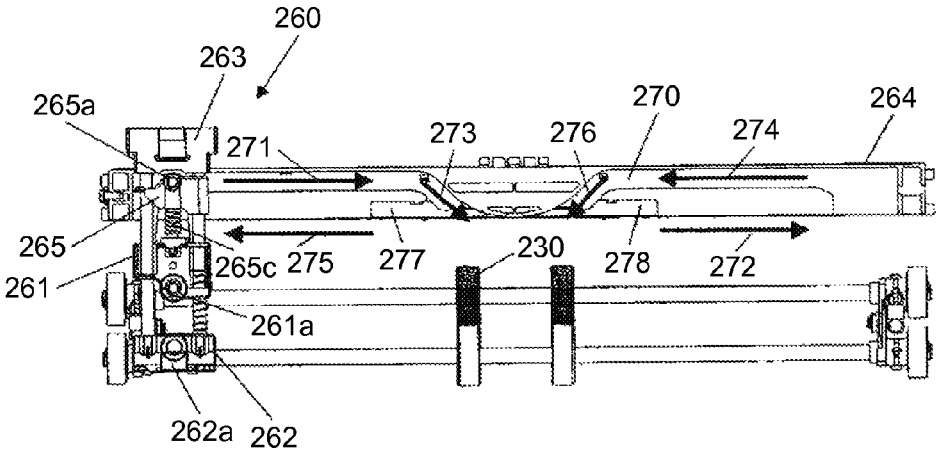
FIG. 13 illustrates a guide member in more detail.

FIG. 13 illustrates the guide member 264 in more detail. The guide member 264 includes a guide path 270 that guides the additional-folding roller unit 260 in the width direction of the sheet bundle SB. Six paths including a first guide path 271, a second guide path 272, a third guide path 273, a fourth guide path 274, a fifth guide path 275, and a sixth guide path 276 are set in the guide path 270.

The first guide path 271 is for guiding the pressing mechanism 265 in a pressing-released state during an outward movement. The second guide path 272 is for guiding the pressing mechanism 265 in a pressed state during the outward movement. The third guide path 273 is for switching the pressing mechanism 265 from the pressing-released state to the pressed state during the outward movement. The fourth guide path 274 is for guiding the pressing mechanism 265 in a pressing-released state during a return movement. The fifth guide path 275 is for guiding the pressing mechanism 265 in a pressed state during the return movement. The sixth guide path 276 is for switching the pressing mechanism 265 from the pressing-released state to the pressed state during the return movement.

Figure 14:
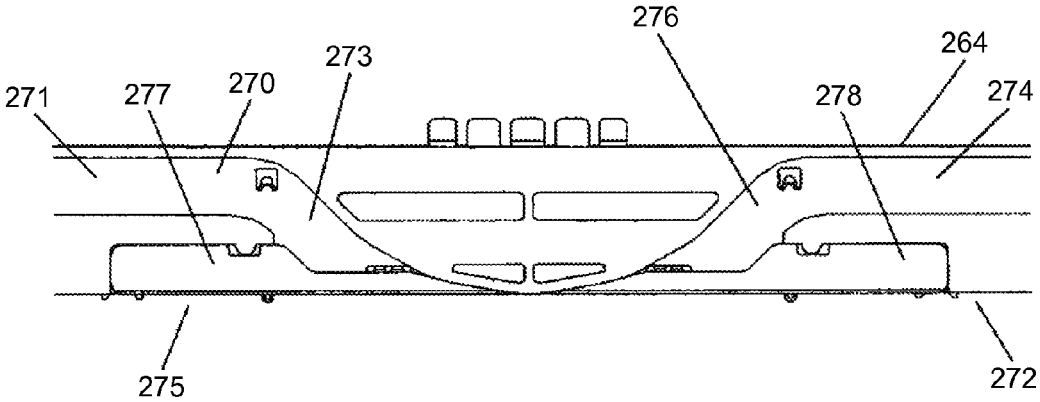
FIG. 14 enlargedly illustrates relevant parts in FIG. 13, illustrating a state where a path switching claw is not switched.
Figure 15:
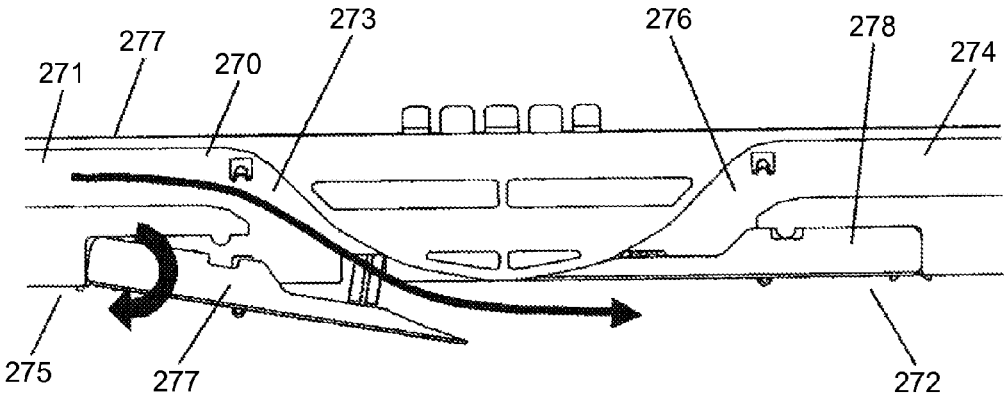
FIG. 15 enlargedly illustrates the relevant parts in FIG. 13, illustrating a state where a first path switching claw has been switched.

FIGS. 14 and 15 enlargedly illustrate the relevant parts in FIG. 13. An arrow in FIG. 15 indicates a movement locus of a guide pin 265*a* of the pressing mechanism 265.

As illustrated in FIGS. 14 and 15, a first path switching claw 277 and a second path switching claw 278 are installed at an intersection between the third guide path 273 and the second guide path 272 and an intersection between the sixth guide path 276 and the fifth guide path 275, respectively.

The pressing mechanism 265 moves along the guide path 270 because the guide pin 265*a* of the pressing mechanism 265 movably fits in the guide path 270 in a loose fit state. That is, the guide path 270 functions as a cam groove and the guide pin 265*a* functions as a cam follower that changes the position while moving along the cam groove.

The first path switching claw 277 is pushed down from above by the guide pin 265*a* of the pressing mechanism 265, thereby rotationally moving to switch the guide path from the third guide path 273 to the second guide path 272 as illustrated in FIG. 15. The second path switching claw 278 is pushed down from above by the guide pin 265*a* of the pressing mechanism 265, thereby rotationally moving to switch the guide path from the sixth guide path 276 to the fifth guide path 275.

Meanwhile, switching by the first path switching claw 277 from the second guide path 272 to the third guide path 273 is impossible and switching by the second path switching claw 278 from the fifth guide path 275 to the sixth guide path 276 is impossible. That is, the first path switching claw 277 and the second path switching claw 278 are configured not to switch the guide path in the opposite directions, respectively.

FIGS. 16 to 26 are operation explanatory diagrams of an additional folding operation performed by the additional-folding roller unit 260.

Figure 16:
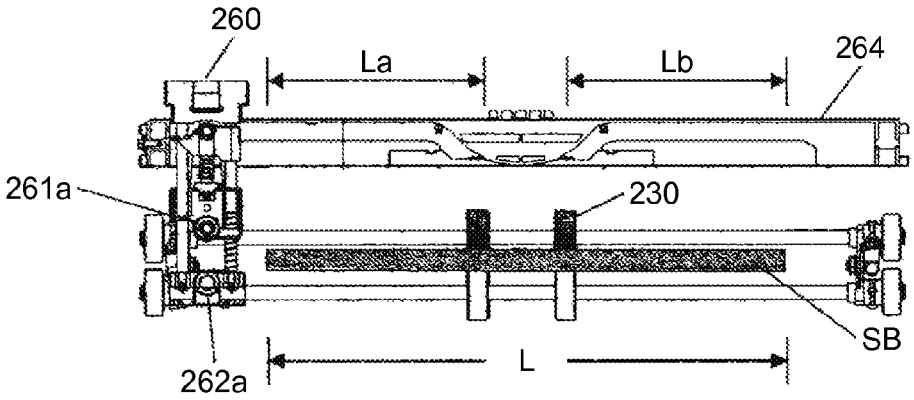
FIG. 16 is an operation explanatory diagram of an initial state of an additional folding operation.

FIG. 16 illustrates a state where the sheet bundle SB folded by the folding roller pair 230 is conveyed to a previously-set additional folding position and stops at that position and the additional-folding roller unit 260 is in a waiting position. This state is an initial position in the additional folding operation.

Figure 17:
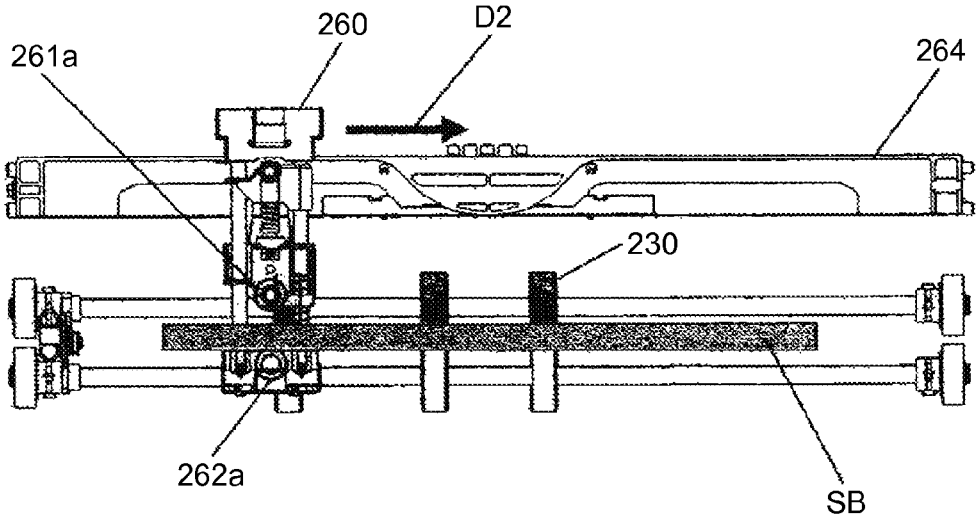
FIG. 17 is an operation explanatory diagram of a state where an outward movement of the additional-folding roller is started.

As illustrated in FIG. 17, the additional-folding roller unit 260 starts an outward movement to the right (in a direction of an arrow D2) in FIG. 17 from the initial position illustrated in FIG. 16. At that time, the pressing mechanism 265 in the additional-folding roller unit 260 moves along the guide path 270 of the guide member 264 by an action of the guide pin 265*a*. The pressing mechanism 265 moves along the first guide path 271 immediately after start of the operation. Meanwhile, the upper additional folding roller 261*a* and the lower additional folding roller 262*a* are in pressing-released states.

In this case, the "pressing-released state" is a state where almost no pressure is applied to the sheet bundle SB while the upper additional folding roller 261*a* and the lower additional folding roller 262*a* contact the sheet bundle SB or a state where the upper additional folding roller 261*a* and the lower additional folding roller 262*a* are separated from the sheet bundle SB.

Figure 18:
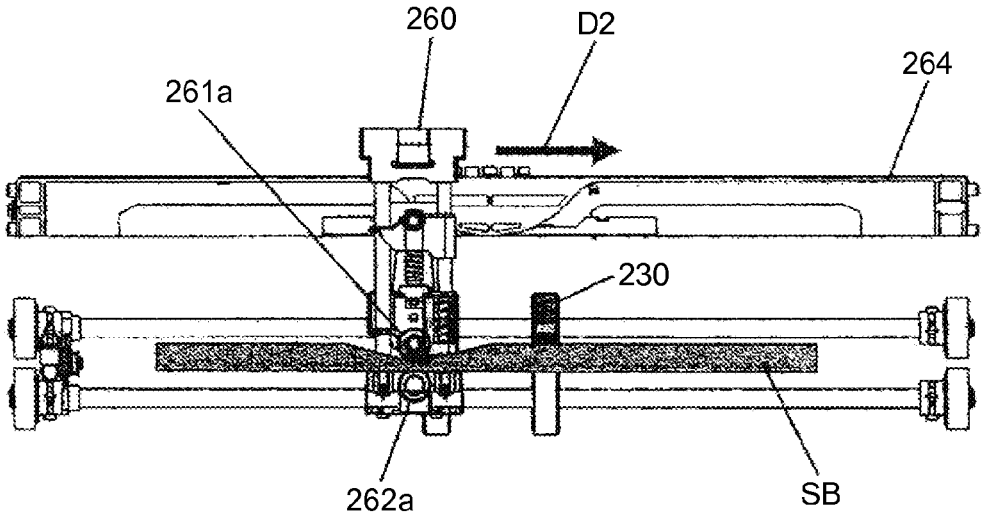
FIG. 18 is an operation explanatory diagram of a state where the additional-folding roller unit falls on a third guide path near the center of a sheet bundle.
Figure 19:
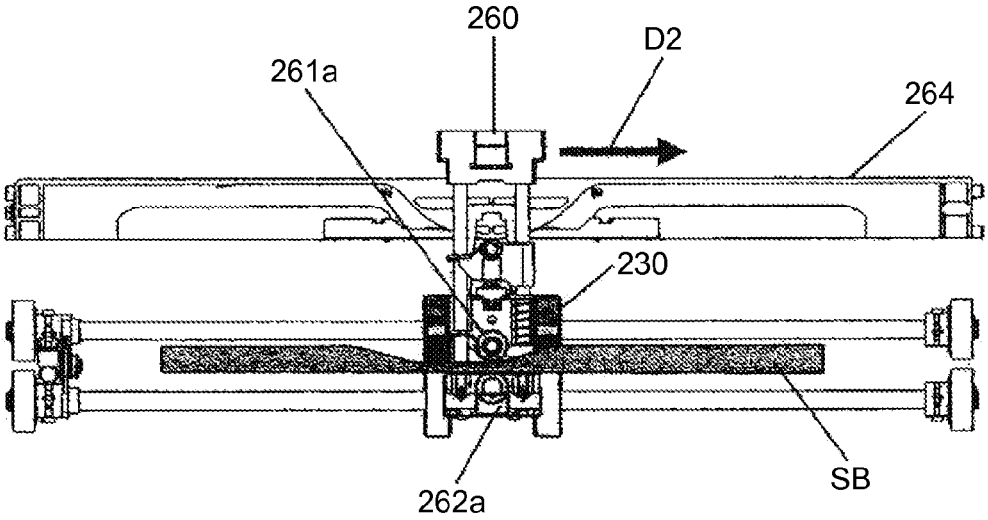
FIG. 19 is an operation explanatory diagram of a state where the additional-folding roller unit enters a second guide path by pushing aside the first path switching claw.

When the additional-folding roller unit 260 falls on the third guide path 273 near the center of the sheet bundle SB as illustrated in FIG. 18, the pressing mechanism 265 starts lowering along the third guide path 273 and enters the second guide path 272 by pushing aside the first path switching claw 277 as illustrated in FIG. 19. At that time, the pressing mechanism 265 is brought into a state to press the additional-folding-roller upper unit 261, and the additional-folding-roller upper unit 261 abuts on the sheet bundle SB to achieve a state where the sheet bundle SB sandwiched by the upper additional folding roller 261*a* and the lower additional folding roller 262*a* is pressed.

Figure 20:
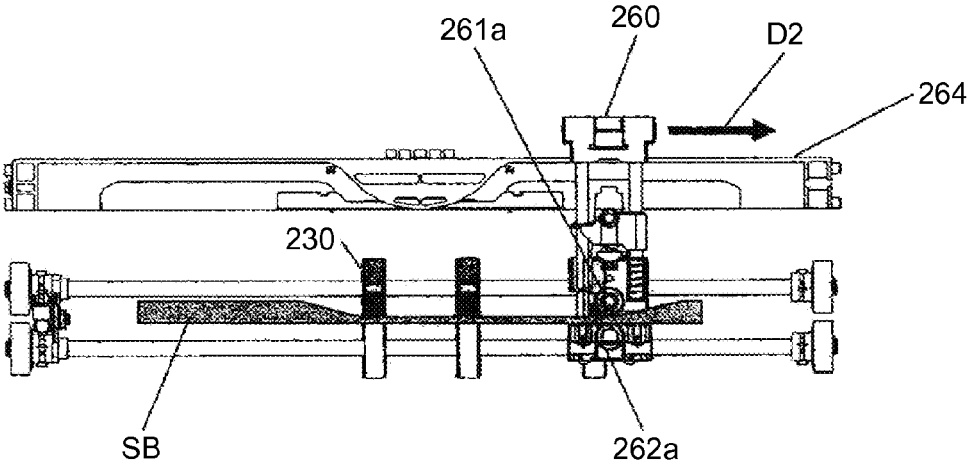
FIG. 20 is an operation explanatory diagram of a state where the additional-folding roller unit moves in an end direction while pressing a sheet bundle.
Figure 21:
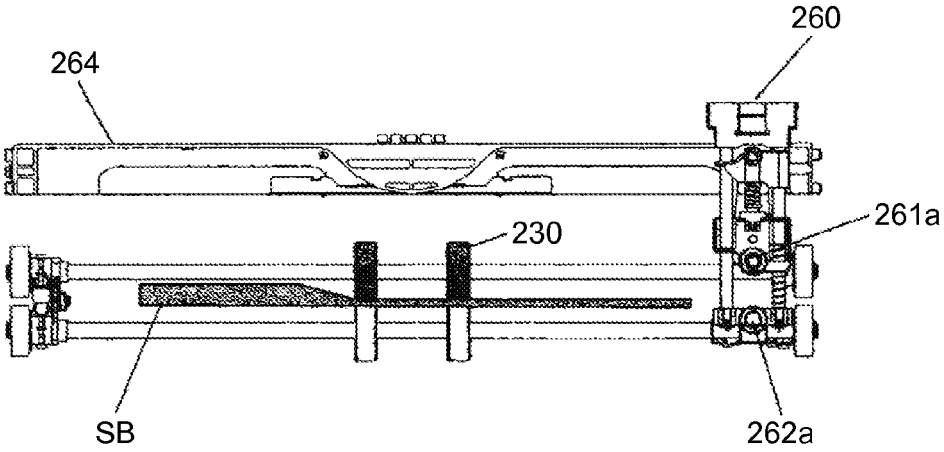
FIG. 21 is an operation explanatory diagram of a state where the additional-folding roller unit has moved to a final position of the outward movement along the second guide path.

In a state where the sheet bundle SB is kept pressed in this way, the additional-folding roller unit 260 further moves as illustrated in FIG. 20 in the direction of an arrow D2 in FIG. 20. At that time, because the second path switching claw 278 cannot move in the opposite direction, the guide pin 265*a* of the pressing mechanism 265 moves along the second guide path 272 without being guided to the sixth guide path 276, passes through the sheet bundle SB as illustrated in FIG. 21, and is located at a final position of the outward movement.

When the additional-folding roller unit 260 moves to this position, the guide pin 265*a* of the pressing mechanism 265 shifts from the second guide path 272 to the fourth guide path 274 located above. As a result, a position restriction of the guide pin 265*a* by an upper surface of the second guide path 272 is released and thus the upper additional folding roller 261*a* is separated from the lower additional folding roller 262*a* to be in the pressing-released state.

Figure 22:
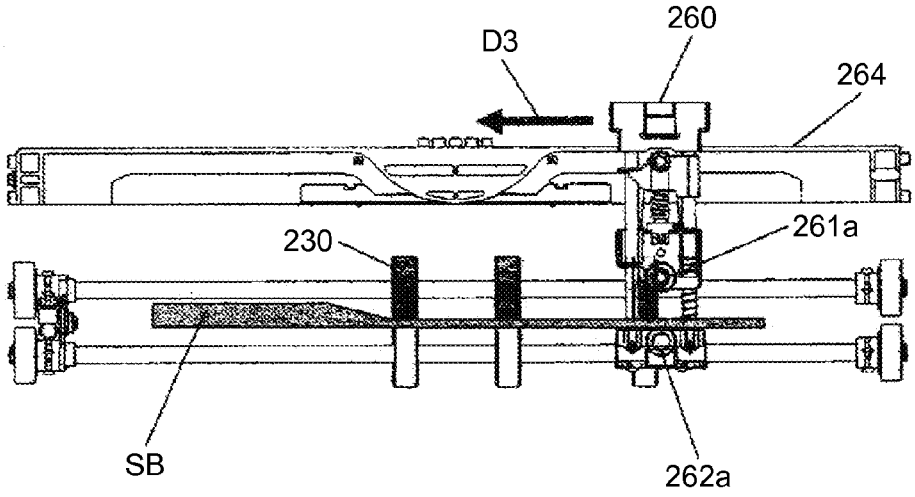
FIG. 22 is an operation explanatory diagram of a state where the additional-folding roller unit has started a return movement from the final position of the outward movement.
Figure 23:
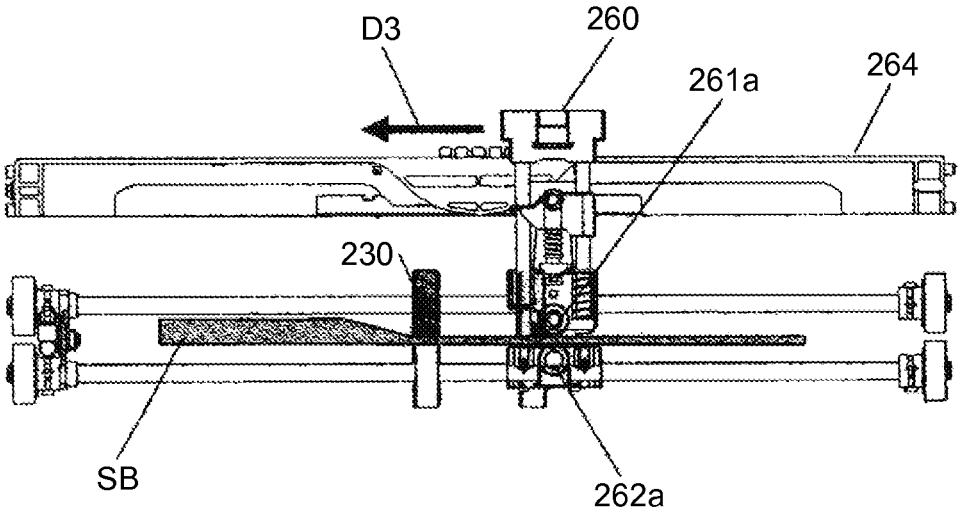
FIG. 23 is an operation explanatory diagram of a state where the additional-folding roller unit has started the return movement and then reaches a sixth guide path.
Figure 24:
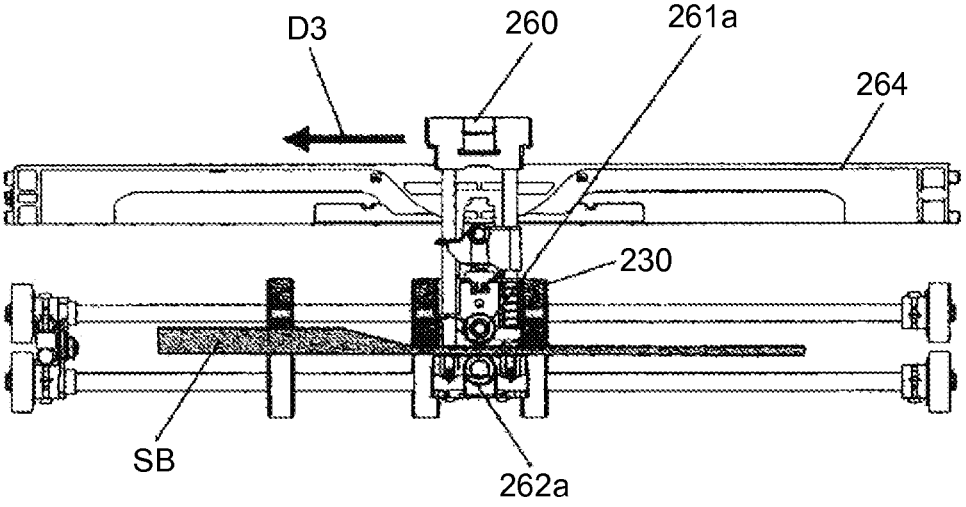
FIG. 24 is an operation explanatory diagram of a state where the additional-folding roller unit has reached the sixth guide path and then shifts from a pressing-released state to a pressed state.

The additional-folding roller unit 260 then starts a return movement by the unit moving mechanism 263 as illustrated in FIG. 22. In the return movement, the pressing mechanism 265 moves along the fourth guide path 274 to the left (in a direction of an arrow D3) in FIG. 22. When the pressing mechanism 265 reaches the sixth guide path 276 due to this movement as illustrated in FIG. 23, the second path switching claw 278 is pushed down by the guide pin 265*a* along the shape of the sixth guide path 276. The pressing mechanism 265 then shifts from the pressing-released state to the pressed state as illustrated in FIG. 24.

Figure 25:
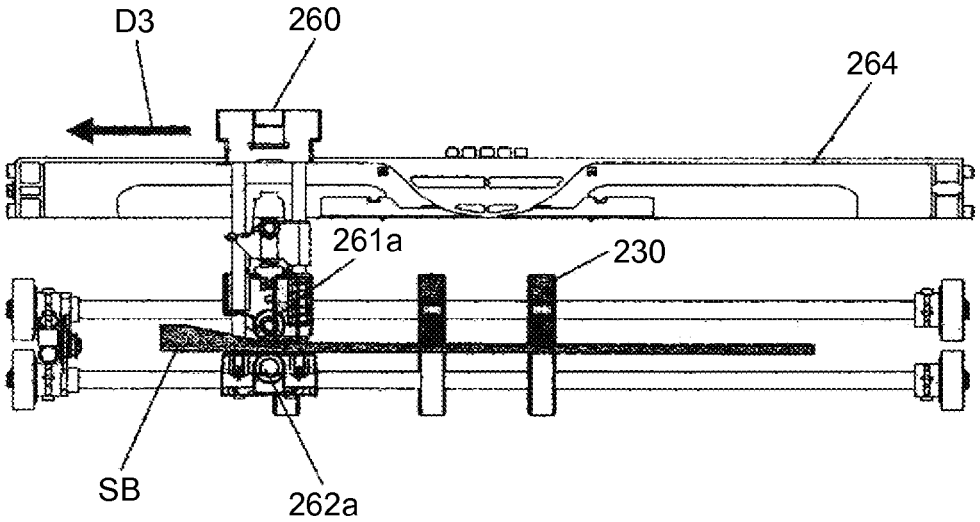
FIG. 25 is an operation explanatory diagram of a state where the additional-folding roller unit has entered a fifth guide path and then brought into a completely pressed state.
Figure 26:
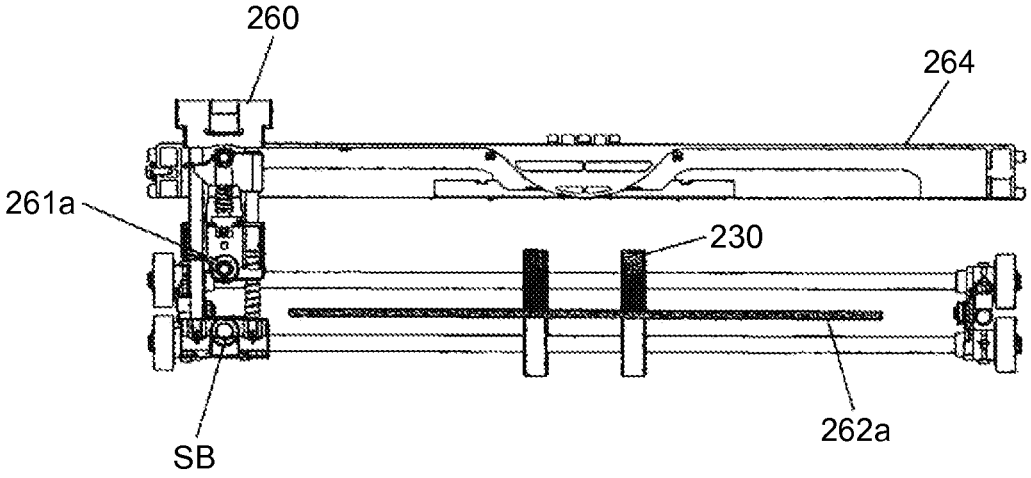
FIG. 26 is an operation explanatory diagram of a state where the additional-folding roller unit has moved in the fifth guide path in the completely pressed state and then returned to an initial state.

Thereafter, when entering the fifth guide path 275 as illustrated in FIG. 25, the additional-folding roller unit 260 is brought into a completely pressed state and moves in this state through the fifth guide path 275 in a direction of an arrow D3 in FIG. 25 so that the additional-folding roller unit 260 passes through the sheet bundle SB as illustrated in FIG. 26.

By reciprocally moving the additional-folding roller unit 260 in the guide path 270 in this way, the sheet bundle SB is additionally folded. At that time, the additional-folding roller unit 260 starts additional folding from the central portion of the sheet bundle SB toward one side and passes through one end of the sheet bundle SB. The additional-folding roller unit 260 then travels on the additionally-folded sheet bundle SB and achieves additional folding in an operation of starting additional folding from the central portion of the sheet bundle SB to the other side and passing through the other end.

By operating the additional-folding roller unit 260 in this way, the upper additional folding roller 261*a* and the lower additional folding roller 262*a* do not contact or pressurize ends of the sheet bundle SB from outsides of the sheet bundle SB when starting additional folding or when passing through one side and then returning to the other side. In other words, the additional-folding roller unit 260 is in the pressing-released state when passing through the ends of the sheet bundle SB from outsides of the ends. Accordingly, no damage occurs on the ends of the sheet bundle SB. Furthermore, because additional folding is performed from a position near the central portion of the sheet bundle SB toward an end, a distance at which the additional-folding roller unit 260 runs in contact with the sheet bundle SB during additional folding is reduced and crimps which are a cause of wrinkles or the like are hardly accumulated. Therefore, when the fold line portion SB1 of the sheet bundle SB is additionally folded, no damage occur on the ends of the sheet bundle SB and occurrence of turns or wrinkles at the fold line portion SB1 and the vicinity thereof due to accumulation of crimps can be also suppressed.

To prevent the upper additional folding roller 261*a* and the lower additional folding roller 262*a* from running on an end of the sheet bundle SB from outside of the end, it suffices to satisfy the following relation. That is, as can be seen from the operation illustrated in FIGS. 16 to 26, a distance at which the additional-folding roller unit 260 moves on the sheet bundle SB in a state where pressing is released during an outward movement is La and a distance at which the additional-folding roller unit 260 moves on the sheet bundle SB in a state where pressing is released during a return movement is Lb. It is essential that a length L in the width direction of the sheet bundle SB, the distance La, and the distance Lb have a relation of L>La+Lb (see FIGS. 16 to 18 and 21 to 23).

It is desirable to set the distances La and Lb substantially equal and to start pressing near the central portion of the sheet bundle SB in the width direction (see FIGS. 20 and 24).

In the additional-folding roller unit 260 in the present embodiment, the additional-folding-roller lower unit 262 is provided to perform additional folding by sandwiching the sheet bundle SB with the upper additional folding roller 261*a* and the lower additional folding roller 262*a*. Alternatively, the additional-folding-roller upper unit 261 and a receiving member (not illustrated) having an abutment surface that faces the additional-folding-roller upper unit 261 can be provided to press the sheet bundle SB therebetween, without providing the additional-folding-roller lower unit 262.

While the additional-folding-roller upper unit 261 is configured to be movable in the upper and lower directions and the additional-folding-roller lower unit 262 is configured to be immovable in the upper and lower directions in the additional-folding roller unit 260 in the present embodiment, the present embodiment is not limited to this configuration. That is, the additional-folding-roller lower unit 262 can be also configured to be movable in upper and lower directions. With this configuration, the upper additional folding roller 261*a* and the lower additional folding roller 262*a* symmetrically move toward and away from the additional folding position. Accordingly, the additional folding position is fixed regardless of the thickness of the sheet bundle SB and damages such as scratches on the sheet bundle SB can be further suppressed.

While additional folding is performed by moving the additional-folding roller unit 260 in a state where the sheet bundle SB is stopped in the embodiment mentioned above, the relation between the additional-folding roller unit 260 and the sheet bundle SB is relative.

The present embodiment can be alternatively configured in such a manner that a pair of the additional folding rollers 261*a* and 262*a* are rotated while pressing the fold line portion SB1 of the sheet bundle SB in a state where the additional-folding roller unit 260 stops in a sheet fold line direction. This example is illustrated in FIG. 27.

Figure 27:
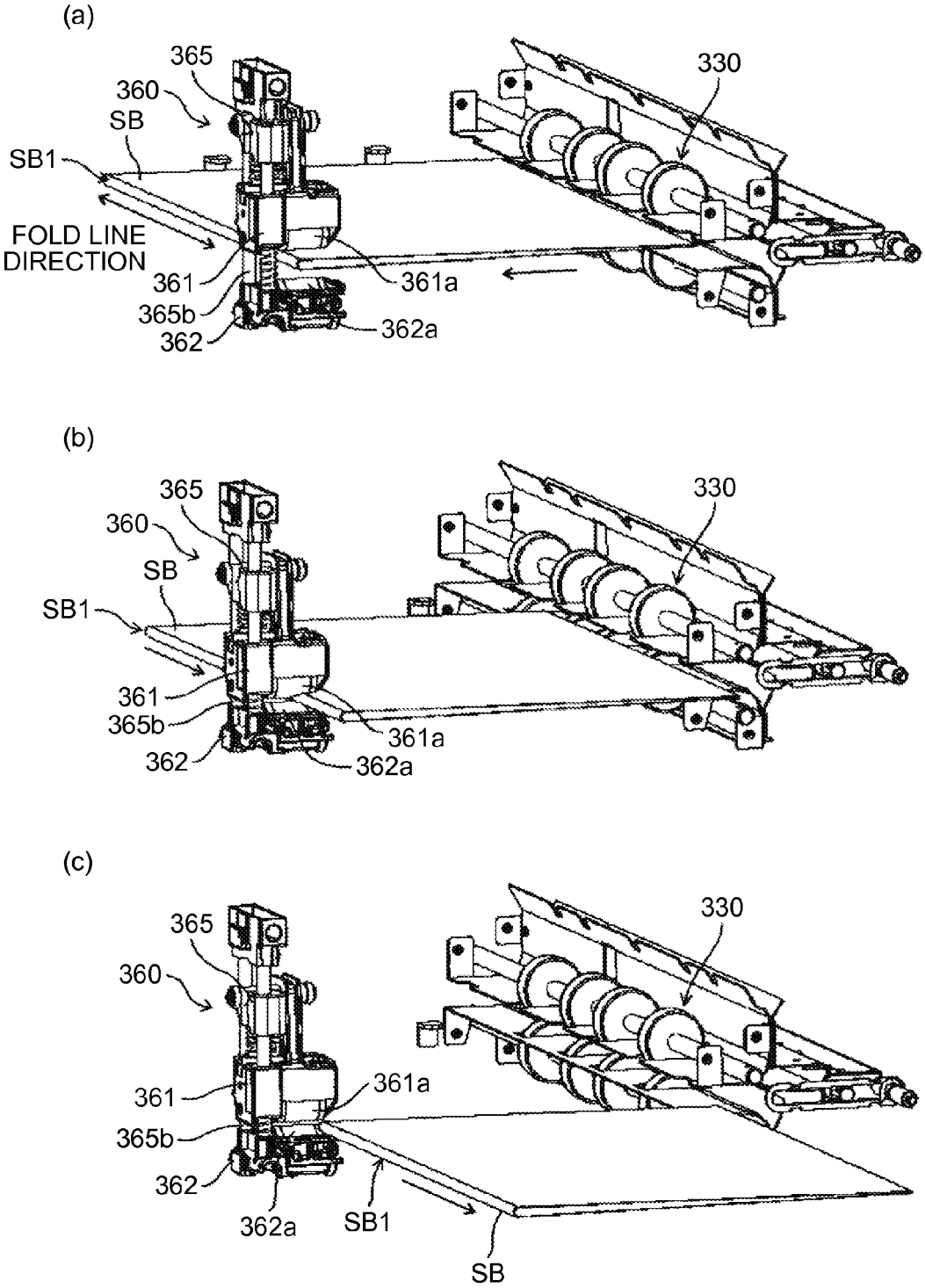
FIG. 27A, FIG. 27B and FIG. 27C illustrate an example in which the additional-folding roller unit is stopped in a sheet fold line direction.

FIG. 27 illustrates another example in which an additional-folding roller unit 360 performs additional folding in a state of being stopped in a sheet fold line direction.

In this example, the sheet bundle SB conveyed by a folding roller pair 330 as illustrated in FIG. 27 is conveyed by a sheet-bundle conveying member (not illustrated) toward the additional-folding roller unit 360.

The sheet bundle SB is received between an upper additional folding roller 361*a* and a lower additional folding roller 362*a* in a state where the upper additional folding roller 361*a* is separated from the lower additional folding roller 362*a* (in the pressing-released state) ((a) of FIG. 27).

Thereafter, the upper additional folding roller 361*a* and the lower additional folding roller 362*a* shift to the pressed state ((b) of FIG. 27). The upper additional folding roller 361*a* and the lower additional folding roller 362*a* in the pressed state are rotationally driven in the fold line direction of the sheet bundle SB.

This causes the sheet bundle SB to be conveyed in the fold line direction ((c) of FIG. 27) and additional folding is executed by the upper additional folding roller 361*a* and the lower additional folding roller 362*a* to the fold line portion SB1 in this process.

In FIG. 27, reference numeral 365 denotes a pressing mechanism, 361 denotes an additional-folding-roller upper unit, 362 denotes an additional-folding-roller lower unit, and 365*b* denotes a support member. These constituent elements have identical functions to those of the pressing mechanism 265, the additional-folding-roller upper unit 261, the additional-folding-roller lower unit 262, and the support member 265*b* mentioned above, respectively.

A relation between the width of the folding roller pair 230 and the density at the fold line portion SB1 of the sheet bundle SB is explained next.

Figure 1:
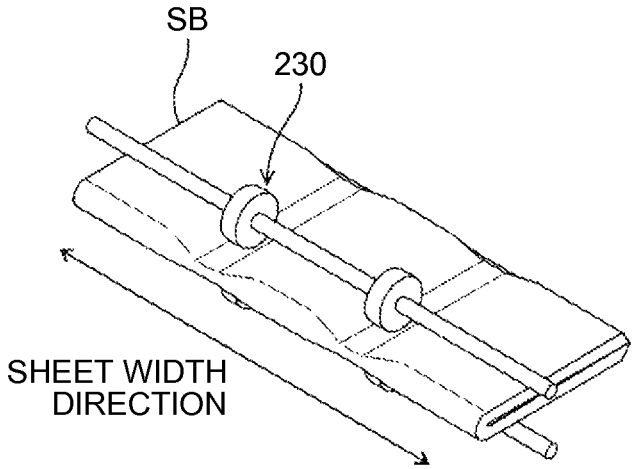
FIG. 1 is a perspective view of a folding roller pair configured within a sheet width, illustrating a state where a sheet bundle is flexed by the folding roller pair.
Figure 28:
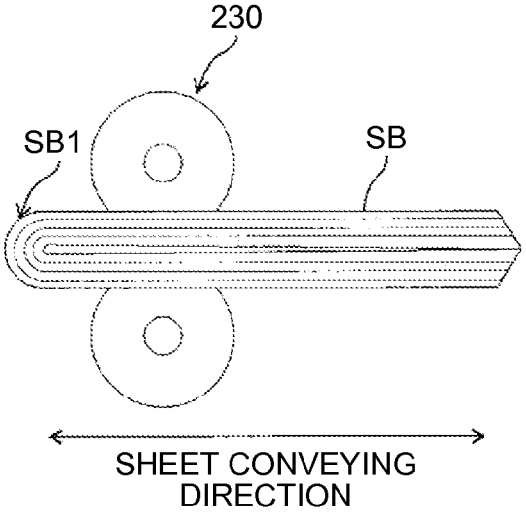
FIG. 28 illustrates the folding roller pair illustrated in FIG. 1 as viewed from an axial direction thereof.
Figure 29:
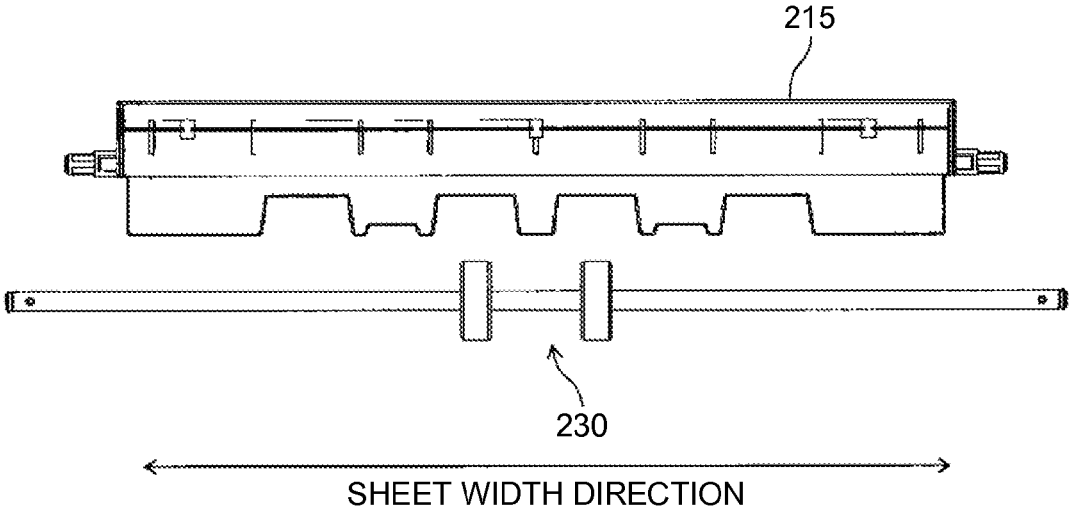
FIG. 29 is a schematic diagram of a positional relation between rollers of the folding roller pair and a folding plate.
Figure 30:
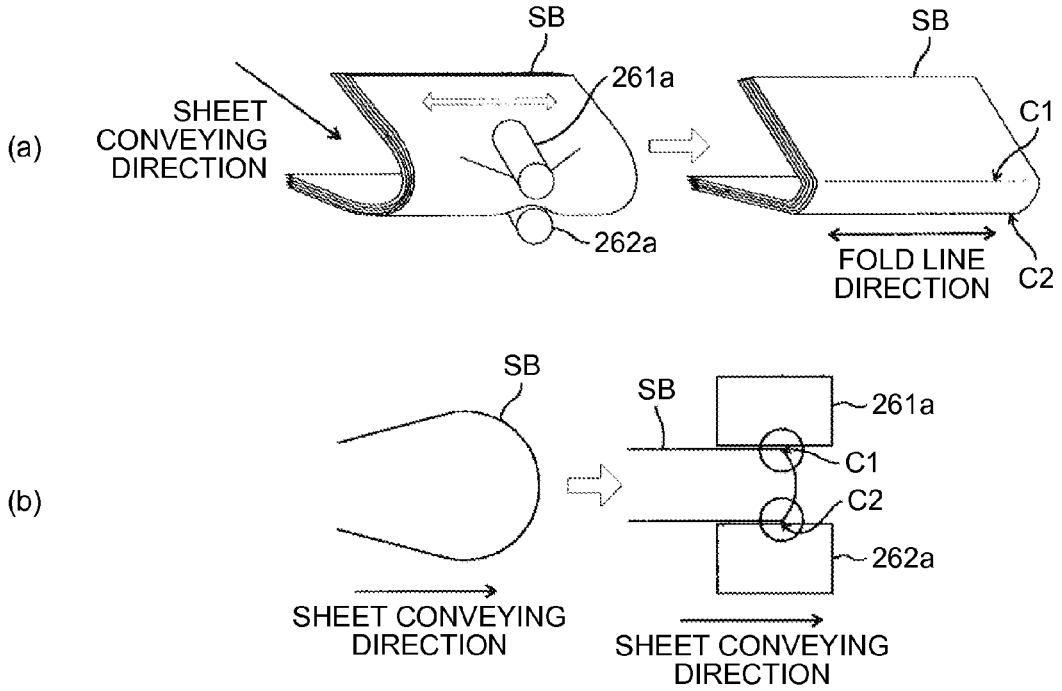
FIG. 30 illustrates (a) an operation performed by an upper additional folding roller and a lower additional folding roller to form two firm fold lines on a flexed portion of a sheet bundle, and (b) a case where the two firm fold lines are formed on a flexed portion of the sheet bundle by the upper additional folding roller and the lower additional folding roller, as viewed from a fold line direction.

FIG. 1 is a perspective view of the folding roller pair 230 configured within the sheet width, illustrating a state where the sheet bundle SB is flexed by the folding roller pair 230. FIG. 28 illustrates the folding roller pair 230 illustrated in FIG. 1 as viewed from an axial direction thereof. FIG. 29 is a schematic diagram of a positional relation between rollers of the folding roller pair 230 and the folding plate 215. In FIG. 30, (a) is a perspective explanatory diagram of an operation performed by the upper additional folding roller 261*a* and the lower additional folding roller 262*a* to form two firm fold lines C1 and C2 on a flexed portion of the sheet bundle SB. In FIG. 30, (b) illustrates a case where the two firm fold lines C1 and C2 are formed on the flexed portion of the sheet bundle SB by the upper additional folding roller 261*a* and the lower additional folding roller 262*a*, as viewed from the fold line direction.

In the present embodiment, a width of a portion of the sheet bundle SB held by the folding roller pair 230 in the sheet width direction is equal to or smaller than half of the sheet width. A portion of the sheet bundle SB not held by the folding roller pair 230 is in a state expanded (flexed) due to firmness (elasticity) of the sheets. In this state, the sheet density of the flexed portion is reduced and gaps are formed between adjacent sheets, so that spaces for deforming the sheets can be formed between adjacent sheets at the flexed portion. Therefore, when the flexed portion of the sheet bundle SB is moved in a direction orthogonal to the sheet conveying direction with being pressurized by the upper additional folding roller 261*a* and the lower additional folding roller 262*a* of the additional-folding roller unit 260 as illustrated in FIG. 30, the flexed portion of the sheets can be greatly deformed, thereby forming the two firm fold lines C1 and C2 on the flexed portion of the sheets. Furthermore, the folded height of the sheet bundle SB can be reduced more in the sheet bundle SB having the two fold lines C1 and C2 formed thereon than in the sheet bundle SB having one fold line formed thereon.

Figure 31:
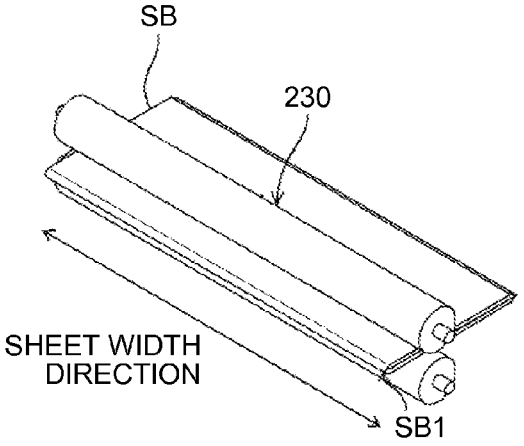
FIG. 31 is a perspective view of a folding roller pair, illustrating a state where a sheet bundle is folded by a folding roller pair having a width longer than the sheet width of the sheet bundle.
Figure 32:
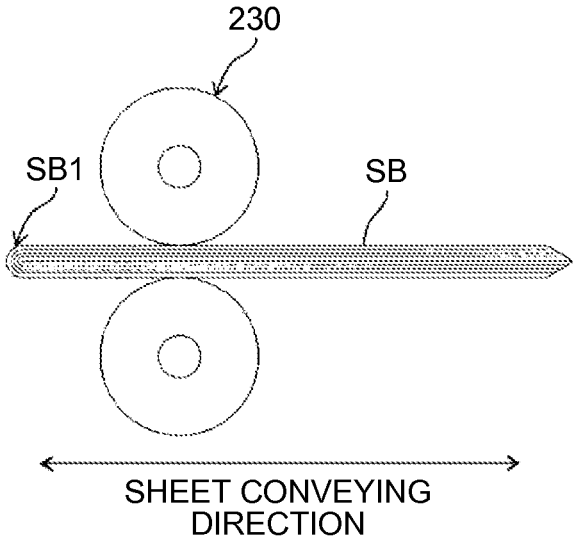
FIG. 32 illustrates the folding roller pair in FIG. 31 as viewed from an axial direction thereof.

FIG. 31 illustrates the sheet bundle SB folded by the folding roller pair 230 having a width longer than the sheet width of the sheet bundle SB as an comparative example. FIG. 32 illustrates the folding roller pair 230 in FIG. 31 as viewed from an axial direction thereof.

Because the sheet bundle SB is held by the folding roller pair 230 in a state folded in the entire area of the sheet width direction, the fold line portion SB1 does not expand and the sheets are closely superimposed one on top of another. Accordingly, no spaces for deforming the sheets are provided and the sheets can hardly deform, so that a firm fold line cannot be formed when additional folding is performed.

Therefore, the folding roller pair 230 in the present embodiment is configured in such a manner that the width of a portion of the sheet bundle SB held by the folding roller pair 230 in the sheet width direction is equal to or smaller than half of the sheet width as illustrated in FIG. 1. This enables to form firm fold lines on the sheet bundle SB by performing additional folding and, as a result, the folded height of the sheet bundle SB can be reduced.

While the folding roller pair 230 is composed of two rollers in FIG. 1, more than two rollers can be provided. However, when a portion of the sheet bundle SB held by the rollers of the folding roller pair 230 is large, the additional folding effect mentioned above is adversely reduced. Accordingly, it suffices to provide the rollers in such a manner that a portion of the sheet bundle SB not held by the rollers of the folding roller pair 230 is longer in the sheet width direction than a portion of the sheet bundle SB held by the rollers.

The rollers of the folding roller pair 230 are located within the sheet width of the sheet bundle SB and the folding roller pair 230 holds the sheet bundle SB on insides of both ends of the sheet bundle SB in the sheet width direction, so that the both ends of the sheet bundle SB in the sheet width direction are not held by the folding roller pair 230. Accordingly, the both ends of the sheet bundle SB in the sheet width direction are free and thus the fold line portion SB1 is in a more expanded state. Therefore, the sheet density at the fold line portion SB1 is lowered and a firm crease can be easily formed on the fold line portion SB1 by performing additional folding with the additional-folding roller unit 260.

When the sheet bundle SB is folded by the folding roller pair 230, a position of pressing on the sheet bundle SB by the folding roller pair 230 desirably includes a start position of additional folding by the additional-folding roller unit 260. This brings the sheet bundle SB into a state relatively folded by the folding roller pair 230 at a start point of additional folding of the sheet bundle SB by the additional-folding roller unit 260. Accordingly, the amount of flattening of the sheet bundle SB at a start time of additional folding by the additional-folding roller unit 260 can be reduced and thus reduction in a drive load of the additional-folding roller unit 260 and suppression of damages on the sheets can be achieved.

Figure 33:
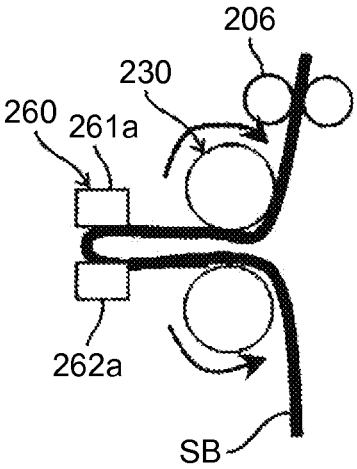
FIG. 33 illustrates a state where an upper roller and a lower roller of the folding roller pair that face each other are provided as being separated from each other with a predetermined distance.

When the folding roller pair 230 is configured in this way, the sheet bundle SB may be locally folded by the folding roller pair 230, thereby leaving prints of the rollers on the sheets. To avoid this, an upper roller and a lower roller of the folding roller pair 230 that face each other can be provided as being separated from each other with a predetermined distance as illustrated in FIG. 33. This reduces a pressing force of the folding roller pair 230 on the sheet bundle SB and can correspondingly suppress prints of the rollers from leaving on the sheets.

By forming an edge portion of each of the rollers of the folding roller pair 230 in a round shape, it is possible to cause prints of the rollers to hardly leave on the sheets.

The embodiment mentioned above is merely an example and the present invention has effects specific to each of the following modes.

Mode A

A sheet processing apparatus such as the saddle-stitch binding apparatus 2 includes: a flexure forming unit such as the folding roller pair 230 that flexes sheets to include a portion on which no fold line is formed in a direction orthogonal to a sheet conveying direction; a first pressing member pair such as the additional-folding roller unit 260 that presses a flexure portion of the flexed sheets, thereby forming a fold line thereon; and a moving unit that moves a pressing position of the first pressing member pair in the direction orthogonal to the sheet conveying direction.

In Mode A, the flexure portion expands due to firmness of the sheets and gaps are formed between adjacent sheets, respectively, so that spaces for deforming the sheets can be provided between adjacent sheets at the fold line. Therefore, when the first pressing member pair presses the fold line of a sheet bundle, the sheets can be greatly deformed at a portion of the flexure portion in which the spaces are formed, thereby forming two firm fold lines on the flexure portion of the sheets. Accordingly, a folded height of the sheet bundle can be reduced as much as the two firm fold lines can be formed on the flexure portion.

Mode B

In Mode A, the flexure forming unit includes a second pressing member pair including pressing members that partially press the sheets in the direction orthogonal to the sheet conveying direction to form a fold line on a pressed portion of the sheets and that flex the sheets not to form a fold line on a portion other than the pressed portion.

Mode C

In Mode B, a width of a portion of the sheets pressed by the second pressing member pair is equal to or smaller than half of a sheet width. Accordingly, as explained in the above embodiment, a length of a portion of a sheet bundle held by the second pressing member pair in a sheet width direction is smaller than that of a portion of the sheet bundle not held by the second pressing member pair. Therefore, spaces for deforming the sheets can be provided between adjacent sheets at the fold line in a wider range than that where the fold line is formed.

Mode D

In Mode A, the flexure forming unit includes an abutment member pair (e.g., folding roller pair 230) including abutment members, and the abutment member pair abuts on the sheets with the abutment members separated from each other to flex the sheets not to form a fold line on the sheets. Accordingly, as explained in the above embodiment, the spaces for deforming the sheets can be provided between adjacent sheets on the flexure portion.

Mode E

In Mode B or Mode C, the second pressing member pair presses the sheets on insides of both ends of the sheets in a sheet width direction. Accordingly, as explained in the above embodiment, because both ends of the sheet bundle in a sheet width direction are not pressed by the second pressing member pair, the fold line on the sheet bundle is in a more expanded state and, as a result, a firm crease can be formed.

Mode F

In Mode B, Mode C, or Mode E, the second pressing member pair is installed with a predetermined distance apart from each of the pressing members. Accordingly, the sheet bundle is not sandwiched firmly by the second pressing member pair, so that a firm fold line is not formed on the sheet bundle by the second pressing member pair and also formation of prints of the second pressing member pair on the sheets can be suppressed.

Mode G

In Mode A, Mode B, Mode C, Mode D, or Mode E, the flexure forming unit is a roller pair having a pair of roller members arranged to sandwich the sheet bundle therebetween, and edge portions of the roller members have round shapes, respectively. Accordingly, as explained in the above embodiment, prints of rollers are not easily formed on the sheets by the roller pair.

Mode H

In Mode A, Mode B, Mode C, Mode D, Mode E, Mode F, or Mode G, the first pressing member pair is configured to start a pressing operation from a predetermined position within a sheet width, and a position on the sheets pressed by the flexure forming unit during flexing of the sheets includes the predetermined position. Accordingly, as explained in the above embodiment, the amount of flattening of the sheet bundle by the first pressing member pair at a start of pressing can be reduced and reduction in a drive load of the first pressing member pair and suppression of damages on the sheets can be achieved.

Mode I

In Mode A, Mode B, Mode C, Mode D, Mode E, Mode F, Mode G, or Mode H, the first pressing member pair is a roller pair having an axis line in a direction orthogonal to a sheet width direction and including a pair of roller members arranged to sandwich a fold line of the sheets therebetween, presses the fold line of the sheets from a predetermined position within a sheet width to one end of the sheets in the sheet width direction, and then presses a portion of the fold line not pressed in a previous pressing operation while moving in an opposite direction of the sheet width direction. Accordingly, when a fold line of the sheet bundle is additionally folded, no damages occur on the ends of the sheet bundle and occurrence of turns or wrinkles at the fold line and the vicinity thereof due to accumulation of crimps can be suppressed.

Mode J

In an image forming system such as the image forming system 4 including: an image forming apparatus such as the image forming apparatus 3 that forms images on sheets, respectively; and a sheet processing apparatus such as the saddle-stitch binding apparatus 2 that performs a folding process to the sheets each having the image formed by the image forming apparatus, the sheet processing apparatus of Mode A, Mode B, Mode C, Mode D, Mode E, Mode F, Mode G, Mode H, or Mode I is used as the sheet processing apparatus. Accordingly, as explained in the above embodiment, a folded height of the sheet bundle on which images are formed can be sufficiently reduced.

As described above, the embodiments exhibit remarkable effects such that two firm fold lines can be formed on a sheet bundle and the folded height of the sheet bundle can be reduced.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus, comprising:

a flexure forming unit configured to flex sheets to include a portion on which no fold line is formed in a direction orthogonal to a sheet conveying direction;

a first pressing member pair, which is next to the flexure forming unit, configured to press a flexure portion of the flexed sheets to form a fold line thereon; and a moving unit configured to move a pressing position of the first pressing member pair in the direction orthogonal to the sheet conveying direction.

2. The sheet processing apparatus according to claim 1, wherein the flexure forming unit includes a second pressing member pair including pressing members that partially press the sheets in the direction orthogonal to the sheet conveying direction to form a fold line on a pressed portion of the sheets and that flex the sheets not to form a fold line on a portion other than the pressed portion.

3. The sheet processing apparatus according to claim 2, wherein a width of a portion of the sheets pressed by the second pressing member pair is equal to or smaller than half of a sheet width.

4. The sheet processing apparatus according to claim 1, wherein the flexure forming unit includes an abutment member pair including abutment members, and the abutment member pair is configured to abut on the sheets with the abutment members separated from each other to flex the sheets not to form a fold line on the sheets.

5. The sheet processing apparatus according to claim 2, wherein the second pressing member pair is configured to press the sheets on insides of both ends of the sheets in a sheet width direction.

6. The sheet processing apparatus according to claim 2, wherein the second pressing member pair is installed with a predetermined distance apart from each of the pressing members.

7. The sheet processing apparatus according to claim 1, wherein the flexure forming unit is a roller pair including a pair of roller members arranged to sandwich the sheets therebetween, and edge portions of the roller members have round shapes, respectively.

8. The sheet processing apparatus according to claim 1, wherein the first pressing member pair is configured to start a pressing operation from a predetermined position within a sheet width, and a position on the sheets pressed by the flexure forming unit during flexing of the sheets includes the predetermined position.

9. The sheet processing apparatus according to claim 1, wherein the first pressing member pair is a roller pair having an axis line in a direction orthogonal to a sheet width direction and including a pair of roller members arranged to sandwich a fold line of the sheets therebetween, the first pressing member pair is configured to press the fold line of the sheets from a predetermined position within a sheet width to one end of the sheets in the sheet width direction, and then press a portion of the fold line not pressed in a previous pressing operation while moving in an opposite direction of the sheet width direction.

10. An image forming system, comprising:

an image forming apparatus configured to form images on sheets, respectively;

a sheet processing apparatus configured to perform a folding process on the sheets each having the image formed by the image forming apparatus; and the sheet processing apparatus according to claim 1.

* * * * *